US011224983B2

(12) United States Patent
Bozikis et al.

(10) Patent No.: US 11,224,983 B2
(45) Date of Patent: Jan. 18, 2022

(54) SHAVING BLADE ASSEMBLY COMPRISING A BLADE UNIT AND A SKIN CONTACT MEMBER AND A RAZOR COMPRISING A RAZOR HANDLE AND SUCH A SHAVING BLADE ASSEMBLY

(71) Applicant: BIC-VIOLEX S.A., Anixi (GR)

(72) Inventors: Ioannis Bozikis, Koukaki-Athens (GR); Panagiotis Kopelas, Dafni-Athens (GR)

(73) Assignee: BIC-VOLEX SA, Anixi (GR)

( * ) Notice: Subject to any disclaimer, the term of this patent is extended or adjusted under 35 U.S.C. 154(b) by 0 days.

(21) Appl. No.: 15/531,856

(22) PCT Filed: Dec. 10, 2014

(86) PCT No.: PCT/EP2014/077243

§ 371 (c)(1),
(2) Date: May 31, 2017

(87) PCT Pub. No.: WO2016/091301

PCT Pub. Date: Jun. 16, 2016

(65) Prior Publication Data

US 2017/0266825 A1 Sep. 21, 2017

(51) Int. Cl.
*B26B 21/40* (2006.01)
*B26B 21/52* (2006.01)

(52) U.S. Cl.
CPC ..... *B26B 21/4031* (2013.01); *B26B 21/4037* (2013.01); *B26B 21/521* (2013.01)

(58) Field of Classification Search
CPC . B26B 21/40; B26B 21/4012; B26B 21/4018; B26B 21/4025; B26B 21/4043
USPC ..... 30/47–51, 84, 41–41.5
See application file for complete search history.

(56) References Cited

U.S. PATENT DOCUMENTS 1,992,565 A * 2/1935 Biegmann ..... B26B 21/18 30/346.61
3,172,202 A * 3/1965 Scooter ..... B26B 21/40 30/539
3,287,803 A * 11/1966 Wauters ..... B26B 29/00 30/539
3,388,468 A * 6/1968 Hamill ..... B26B 21/40 30/540
3,530,574 A * 9/1970 Patterson ..... B26B 21/40 30/540
3,576,071 A * 4/1971 Eriksen ..... B26B 29/00 30/540

(Continued)

FOREIGN PATENT DOCUMENTS

WO WO 2013/050608 A1 4/2013

OTHER PUBLICATIONS

International Search Report of PCT/EP2014/077243 dated Sep. 9, 2015.

*Primary Examiner* — Richard D Crosby, Jr.
(74) *Attorney, Agent, or Firm* — Polsinelli PC

(57) ABSTRACT

A razor including a razor handle and a shaving blade assembly. The shaving blade assembly includes a blade unit and a skin contact member and a razor. The blade unit includes at least one shaving blade having a cutting edge. The blade unit includes a blade unit plane, and the cutting edge includes a first blade angle with regard to the blade unit plane. The skin contact member defines a contact plane, and the cutting edge includes a second blade angle with regard to the contact plane.

18 Claims, 18 Drawing Sheets

(56) References Cited

U.S. PATENT DOCUMENTS 4,328,615 A * 5/1982 Bowman ..... B26B 29/00 30/32
4,425,705 A * 1/1984 Chen ..... B26B 29/00 30/527
4,476,630 A * 10/1984 Byme ..... B26B 21/52 30/47
4,777,722 A * 10/1988 Trotta ..... B26B 21/44 206/349
5,001,832 A * 3/1991 Althaus ..... B26B 21/22 30/77
5,036,587 A * 8/1991 Trotta ..... B26B 21/44 30/41
5,384,961 A * 1/1995 Gregory ..... B26B 21/44 30/41
5,784,785 A * 7/1998 Polites ..... B26B 21/10 30/528
5,893,213 A * 4/1999 Motta ..... B26B 21/4037 30/539
6,185,823 B1 * 2/2001 Brown ..... B26B 21/00 30/50
6,185,827 B1 * 2/2001 Polites ..... B26B 21/40 206/354
6,216,349 B1 * 4/2001 Gilder ..... B26B 21/4031 30/346.57
D449,710 S * 10/2001 Wonderley ..... D28/46
D509,322 S * 9/2005 Wonderley ..... D28/46
D547,494 S * 7/2007 Watson ..... D28/47
7,658,009 B2 * 2/2010 Bunnell ..... B26B 21/44 30/41
7,703,361 B2 * 4/2010 Johnson ..... B26B 21/44 30/41
D619,300 S * 7/2010 Wonderley ..... D28/47
D624,242 S * 9/2010 Bridges ..... D28/47
7,941,931 B2 * 5/2011 Prudden, Jr. ..... B26B 21/4037 30/539
8,011,101 B2 * 9/2011 Coffin ..... B26B 21/44 30/41
8,015,710 B1 * 9/2011 Zyla ..... B26B 21/4037 30/34.05
8,033,023 B2 * 10/2011 Johnson ..... B26B 21/225 30/50
8,037,609 B2 * 10/2011 Nicoll ..... B26B 21/44 30/40
8,209,869 B2 * 7/2012 Royle ..... B26B 21/4018 30/50
8,407,900 B2 * 4/2013 Johnson ..... B26B 21/4012 30/50
9,517,570 B2 * 12/2016 Tucker ..... B26B 21/4031
9,539,734 B1 * 1/2017 Bozikis ..... B26B 21/4068
9,999,980 B2 * 6/2018 Antoniou ..... B26B 21/44
10,144,142 B1 * 12/2018 Squires ..... B26B 21/227
10,421,204 B2 * 9/2019 Griffin ..... B26B 21/4012
10,493,644 B2 * 12/2019 Bozikis ..... B26B 21/521
10,549,437 B2 * 2/2020 Antoniou ..... B26B 21/44
2005/0198840 A1 * 9/2005 Worrick, III ..... B26B 21/4075 30/527
2006/0070242 A1 * 4/2006 Szczepanowski ..... B26B 21/48 30/140
2006/0236546 A1 * 10/2006 Johnson ..... B26B 21/44 30/50
2007/0180700 A9 * 8/2007 Sandor ..... A61K 8/361 30/41
2007/0227010 A1 * 10/2007 Zhuk ..... B26B 21/222 30/50
2008/0256801 A1 * 10/2008 O'Connor ..... B26B 21/225 30/50
2008/0256803 A1 * 10/2008 Tucker ..... B26B 21/225 30/50
2010/0011588 A1 * 1/2010 Wang ..... B26B 21/4031 30/41
2011/0107600 A1 * 5/2011 Royle ..... B26B 21/4018 30/50
2011/0126413 A1 * 6/2011 Szczepanowski .. B26B 21/4087 30/41
2011/0203124 A1 * 8/2011 Bridges ..... B26B 21/4037 30/539
2011/0225833 A1 * 9/2011 Hoffman ..... B26B 21/4037 30/538
2012/0000074 A1 * 1/2012 PazosSchroeder ..... B26B 21/40 30/34.05
2012/0030947 A1 * 2/2012 Walker, Jr. ..... B26B 21/4018 30/50
2012/0030948 A1 * 2/2012 Walker, Jr. ..... B26B 21/4018 30/50
2012/0110857 A1 * 5/2012 Peterson ..... B26B 21/40 30/50
2012/0151772 A1 * 6/2012 Moon ..... B26B 21/225 30/41
2012/0167401 A1 * 7/2012 Quigley ..... B26B 21/4018 30/340
2013/0031794 A1 * 2/2013 Duff, Jr. ..... B26B 21/60 30/526
2013/0199346 A1 * 8/2013 Psimadas ..... B26B 21/225 83/13
2014/0026424 A1 1/2014 Oglesby et al.
2014/0245613 A1 * 9/2014 Good ..... B26B 21/222 30/50
2014/0259675 A1 9/2014 Tucker et al.
2014/0283387 A1 * 9/2014 Bozikis ..... B26B 21/58 30/51
2014/0373362 A1 * 12/2014 Bozikis ..... B26B 21/4031 30/50
2016/0318198 A1 * 11/2016 Brazley ..... B26B 21/4037
2017/0203451 A1 * 7/2017 Griffin ..... B26B 21/4012
2017/0217033 A1 * 8/2017 Tucker ..... B26B 21/443
2017/0266825 A1 * 9/2017 Bozikis ..... B26B 21/4031

* cited by examiner

FIG. 13
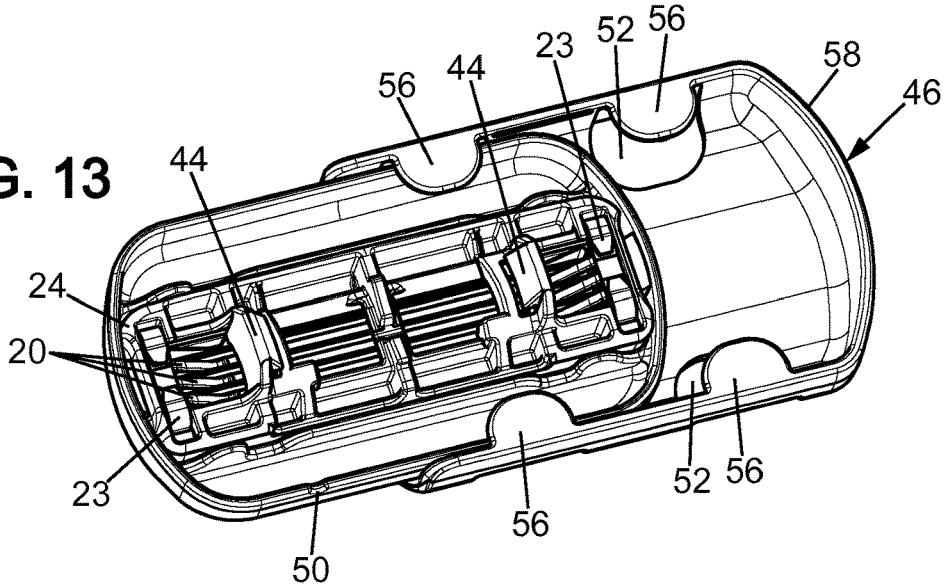
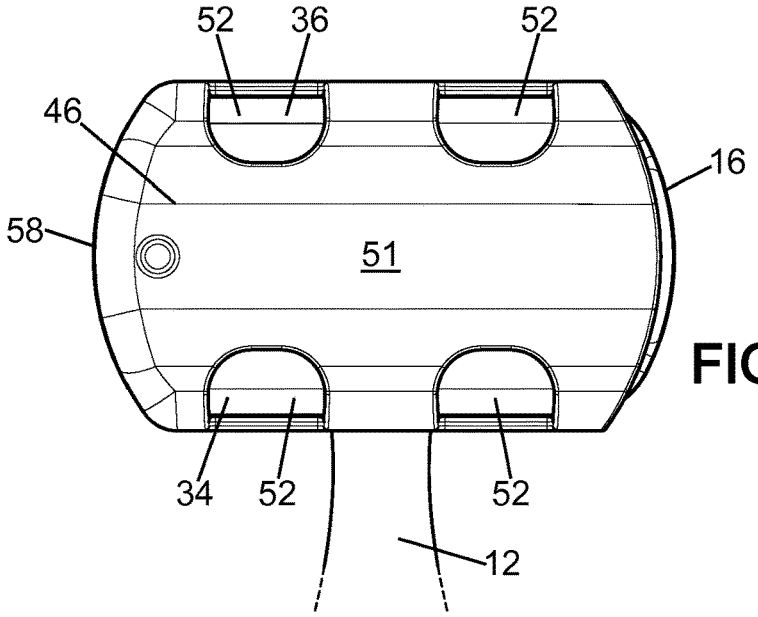
FIG. 14
FIG. 15
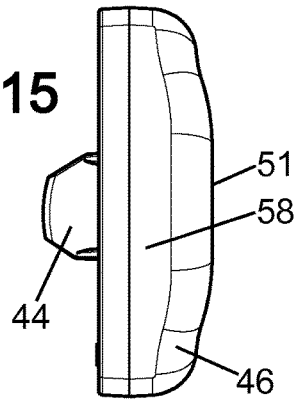

SHAVING BLADE ASSEMBLY COMPRISING A BLADE UNIT AND A SKIN CONTACT MEMBER AND A RAZOR COMPRISING A RAZOR HANDLE AND SUCH A SHAVING BLADE ASSEMBLY

CROSS REFERENCE TO RELATED APPLICATION

This application is a National Stage application of International Application No. PCT/EP2014/077243, filed on Dec. 10, 2014, the entire contents of which is incorporated herein by reference.

BACKGROUND

1. Field

The disclosure relates to a shaving blade assembly including a blade unit and a skin contact member and a razor including a razor handle and a shaving blade assembly. In particular, the disclosure relates to shaving blade assemblies including a blade unit and an adaptor or skin contact member.

2. Description of the Related

Shaving blade assemblies allow for a user to maintain a smooth relation between the blades and the skin during shaving in such a way that the user is able to prevent any concentrated pressure from the blades to the skin.

Known shaving blade assemblies commonly include a skin contact member provided with shaving aid such as a lubricant, a moisturizer, a conditioner and/or an exfoliant to improve the glideness of the razor.

However, the shaving aid gets worn out, changing the dimensions of the shaving aid with respect to the blade assembly, and as a result, the user is more susceptible to being nick and cut from the shave.

SUMMARY

A shaving blade assembly is disclosed wherein the shaving blade assembly includes a specific geometry that allows for a good shave throughout the life of the blades. As such, the user is able to enjoy better glideness and smooth skin, free of skin damages that usually result from shaving.

Aspects of the disclosure include a shaving blade assembly including a blade unit having a blade unit plane and a skin contact member. The blade unit may include at least one shaving blade having a cutting edge. The cutting edge may include a first blade angle with regard to the blade unit plane. The skin contact member may include a leading skin contact part extending in front of the shaving blades and a trailing skin contact part extending rearward of the shaving blades. The leading skin contact part may include a leading surface and the trailing skin contact may include a trailing surface. The leading surface and the trailing surface may define a contact plane, wherein the cutting edge has a second blade angle with regard to the contact plane.

The skin contact member may also allow for a change in the shaving blade angle. Each blade has a first blade angle defined with regard to the blade unit and a second blade angle defined with regard to the skin contact member. The shaving blade angle may correspond to the first blade angle when the blade unit is not connected to the skin contact member, whereas the shaving blade angle may correspond to the second blade angle when the blade unit is connected to the skin contact member.

In other words, the position and/or the exposure of the blade and/or the angle of the blade may change when the blade unit is connected to the skin contact member. As a result, the shaving plane may be different when the blade unit is connected to the skin contact member and when the blade unit is not connected to the skin contact member. Therefore, at least a change in the blade angle of the blade units may be allowed without changing the manufacturing of the blade units. As such, "existing" blade units may be used to improve a shave without changing the manufacture of the "existing" blade units, but by connecting the "existing" blade units, instead, to an adaptor or skin contact member.

According to another aspect, a shaving blade assembly may include a blade unit and a skin contact member. The blade unit may include at least one shaving blade having a cutting edge and the blade unit having a blade unit plane. The skin contact member may include a leading skin contact part extending in front of the shaving blades and a trailing skin contact part extending rearward of the shaving blades. The leading skin contact part may include a leading planar surface and the trailing skin contact may include a trailing planar surface. The leading planar surface and the trailing planar surface may define a contact plane, wherein the contact plane and the assembly plane may be parallel. The distance between the contact plane and the assembly plane may be between 0.1 mm and 0.6 mm. According to a further aspect, the distance between the contact plane and the assembly plane may be between 0.2 mm and 0.6 mm.

Another aspect may include a shaving blade assembly having a ratio between the shaving blade assembly skin contact surface area and the blade unit skin contact surface area which may be between 2 and 3.1.

Yet another aspect may include a shaving blade assembly having a ratio between the shaving blade assembly skin contact surface area and the blade unit skin contact surface area which may be between 1.4 and 1.95.

Aspects of the disclosure eliminate the need to provide the skin contact member with a shaving aid. The skin contact member may be configured to spread the pressure that the user applies on a wider area of the skin and may prevent the intense deformation (skin bulge) of the skin that is caused by the blade unit without the skin contact member. The skin contact member may be manufactured with single injection moulding; as a result, the manufacturing costs of the shaving blade assembly may thus be cheaper.

The skin contact member may act as an adaptor for changing the blade angle and/or as a stretcher on the skin while allowing glideness. In addition, the skin contact member may be produced in a single production step, which means lower production cost and easier quality control.

The skin contact member may also protect the user against wrong movements (such as for example in the lateral direction) and may absorb the excessive pressure that might provoke micro injuries and irritation on the skin, thereby allowing for a smoother shave.

Various aspects of the skin contact member may incorporate one or more of the following features:

The cutting edge may include a first blade exposure with regard to the blade unit plane;

The cutting edge may include a second blade exposure with regard to the contact plane;

The blade unit may include several shaving blades, each shaving blade having a cutting edge, each of the cutting edges may include a first blade angle with regard to the blade unit plane and each of the cutting edges may include a second blade angle with regard to the contact plane;

The blade unit may include several shaving blades, each shaving blade having a cutting edge, each of the cutting edges may include a first blade exposure with regard to the blade unit plane and each of the cutting edges may include a second blade exposure with regard to the contact plane. The blade unit may include several blades. Each blade may include a first and a second angle different from the first and second angle; respectively, of another blade Additionally, for one specific blade, for example, the first and second angles may be different. On the contrary, each of the first blade angles may also be equal. Each of the second blade angles may also be equal, the second blade angles may be equal to or different from the first blade angles. The same may occur with the blade exposure.

The second blade angle may be equal to the first blade angle;

The second blade angle may be different from the first blade angle;

The second blade angle may be greater than the first blade angle;

The second blade angle may be smaller than the first blade angle;

The second blade exposure may be equal to the first blade exposure;

The second blade exposure may be different from the first blade exposure;

The second blade exposure may be greater than the first blade exposure;

The second blade exposure may be smaller than the first blade exposure;

The blade unit plane and the contact plane may be intersecting;

The shaving blade assembly may have an assembly plane which may be parallel the contact plane and which may be tangent to the aft-most blade edge;

The leading surface may be planar;

The trailing surface may be planar;

The distance between the contact plane and the assembly plane may be between 0.1 mm and 0.6 mm;

The distance between the contact plane and the assembly plane may also be between 0.2 mm and 0.6 mm;

The blade unit may include a blade unit skin contact surface area. The blade unit and the skin contact member may include a shaving blade assembly skin contact surface area. The ratio between the shaving blade assembly skin contact surface area and the blade unit skin contact surface area may be between 2 and 3.1;

The blade unit may include a blade unit skin contact surface area. The blade unit and the skin contact member may include a shaving blade assembly skin contact surface area, wherein the ratio between the shaving blade assembly skin contact surface area and the blade unit skin contact surface area (S1) may be between 1.4 and 1.95;

The skin contact member may be without any shaving aid; thus, the skin contact member may not include a shaving aid;

The blade unit may further include a guard and a cap. The guard may be disposed in front of the cutting edge. The cap may be disposed on a shaving aid or lubra may be located rearward of the cutting edge. The blade unit plane may be tangent to the guard and the cap of the blade unit;

The skin contact member may be motionless when secured to the blade unit. For example, the skin contact member may not be allowed to deflect with regard to the blade unit during shaving. The skin contact member may surround the blade unit, for example, the skin contact member may be snap-fitted to the blade unit;

The blade unit may include a housing having an upper face, the blade edge may face toward the upper face, wherein the skin contact member may be connected to the upper face of the blade unit;

The skin contact member may include cut outs;

The skin contact member may include a leading skin contact part extending forward of the shaving blade and a trailing skin contact part extending rearward of the shaving blade. The leading skin contact part may include a leading planar surface and the trailing skin contact may include a trailing planar surface. The leading planar surface and the trailing planar surface may define a contact plane. The leading skin contact part may further include a leading longitudinal face which may be connected to the leading planar surface via a leading curved. The trailing skin contact part may further include a trailing longitudinal face which may be connected to the trailing planar surface via a trailing curved face. The leading longitudinal face may be sensibly perpendicular to the leading planar surface. The leading curved face may have a radius of curvature of about 2 mm. Similarly, the trailing longitudinal face may be perpendicular to the trailing planar surface wherein the trailing curved face may have a radius of curvature of about 2 mm;

The contact plane may be above the assembly plane;

The contact plane and the assembly plane may be parallel wherein the distance between the contact plane and the assembly plane may be between 0.2 mm and 0.6 mm. The distance between the contact plane and the assembly plane may provide a safe distance between the blade unit and the skin, especially between the blades and the skin, thereby allowing for a fast, smooth, and safer shave;

The ratio between the shaving blade assembly skin contact surface area and the blade unit skin contact surface area may be of about 2.5, and the contact plane and the assembly plane may be parallel, and the distance between the contact plane and the assembly plane may be about 0.3 mm;

The skin contact member may include a material chosen among plastics, metals and/or lacquered wood addition. The skin contact member may have a friction coefficient between 0.3 and 0.7 when the skin contact member is made from a plastic, a friction coefficient between 1.05 and 1.35 when the skin contact member is made from a metal, or a friction coefficient between 0.25 and 0.5 when the skin contact member is made from a lacquered wood. The materials and values of friction coefficients may provide a better stretching to the skin as compared to current shavers using high friction material, such as TPE, to grab skin and pull the skin while shaving. The friction coefficient values indicated here are without use of a lubricant.

The shaving blade assembly may further include a protective cover for shielding the cutting edge. The protective cover may be slidable and may be provided with a locker to hold the protective cover in a full stop position;

The skin contact member may include a locker slot shaped to receive the locker of the protective cover;

The skin contact member may have thermochromic pigments, and thus may be used to pass information to the user;

Another aspect may include a razor having a razor handle and a shaving blade assembly. The shaving blade assembly may include a connecting means for connecting the shaving blade assembly to the razor handle. The razor handle may be connected to the shaving blade assembly pivotally or non-pivotally. When the connection is pivotable, the connecting means may include shell bearings provided on the blade unit.

BRIEF DESCRIPTION OF THE DRAWINGS

Other characteristics and advantages of the disclosure will readily appear from the following description of embodiments, provided as non-limitative examples, in reference to the accompanying drawings.

In the drawings:

FIG. 13 is rear perspective view of the razor of FIG. 12 without the razor handle.

FIG. 14 is a front view of the razor of FIG. 11 with the protective cover attached.

FIG. 15 is a lateral view of the razor of FIG. 14 without the razor handle.

On the different Figures, the same reference signs designate identical or similar elements.

DETAILED DESCRIPTION OF THE DISCLOSURE

Figure 1A:
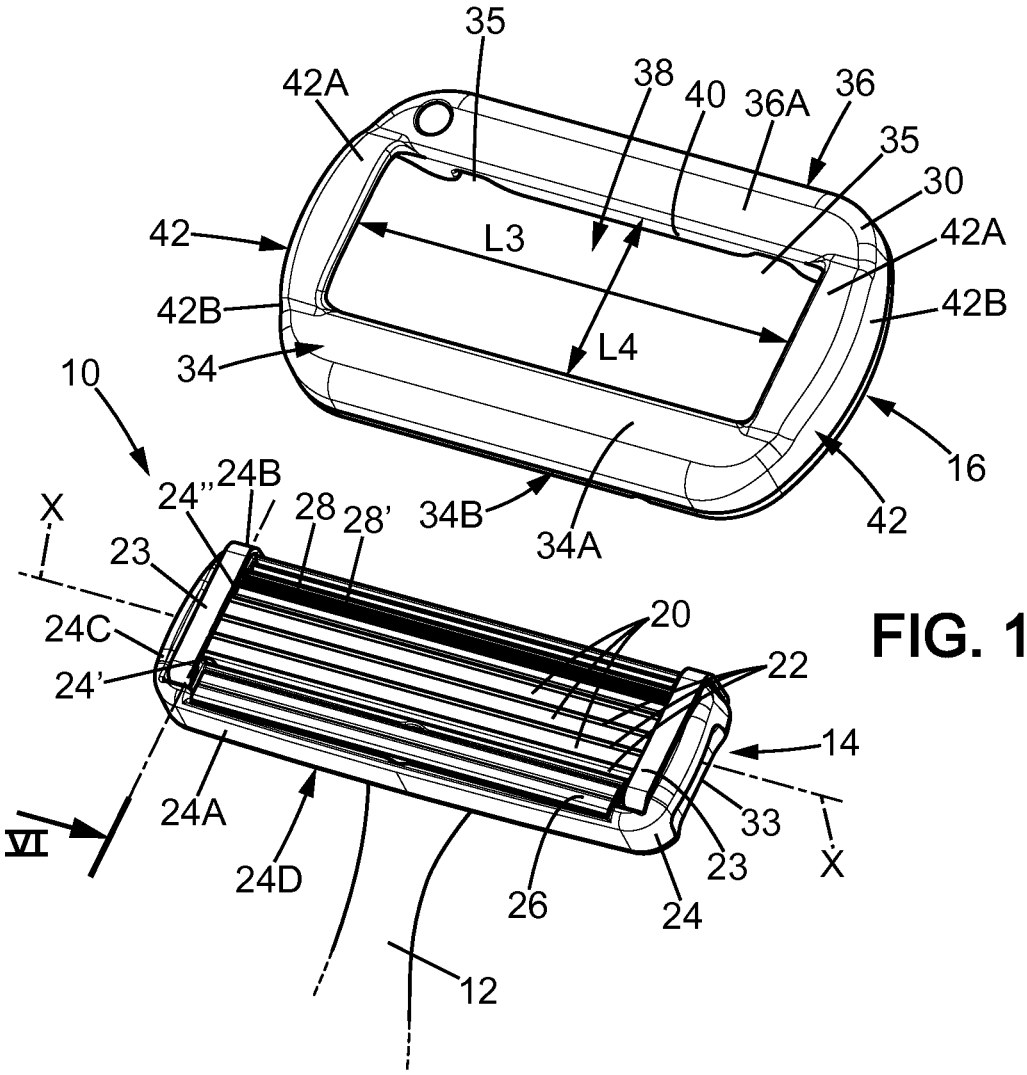
FIG. 1A is a perspective view partially exploded of a razor according to an aspect of the disclosure.

Aspects of the disclosure include a wet razor 10 including a razor handle 12, a shaving blade assembly including a blade unit 14 and a skin contact member 16 which may be connected to the blade unit 14 to form a shaving blade assembly 18.

As shown in FIG. 1A to 1D, 2A to 2D, 5A to 5D or 6A to 6D, the blade unit 14 may include one or more shaving blades 20. Each one of the shaving blades 20 may include a cutting edge 22. More precisely, the blade unit 14 may include a housing 24 having a front edge 24A and a rear edge 24B, an upper face 24C and an opposed lower face 24D into which the one or more shaving blades 20 may be located (between the front edge and the rear edge). The blade edge 22 may face toward the upper face 24C. The skin contact member 16 may be connected to the upper face 24C of the blade unit 14.

The shaving blades 20 may either be movably mounted on elastic fingers located on the housing or may be fixed. When movable, the blades 20 may be secured on the housing 24 with clips 23 as depicted for example on FIG. 1A.

Figure 1B:
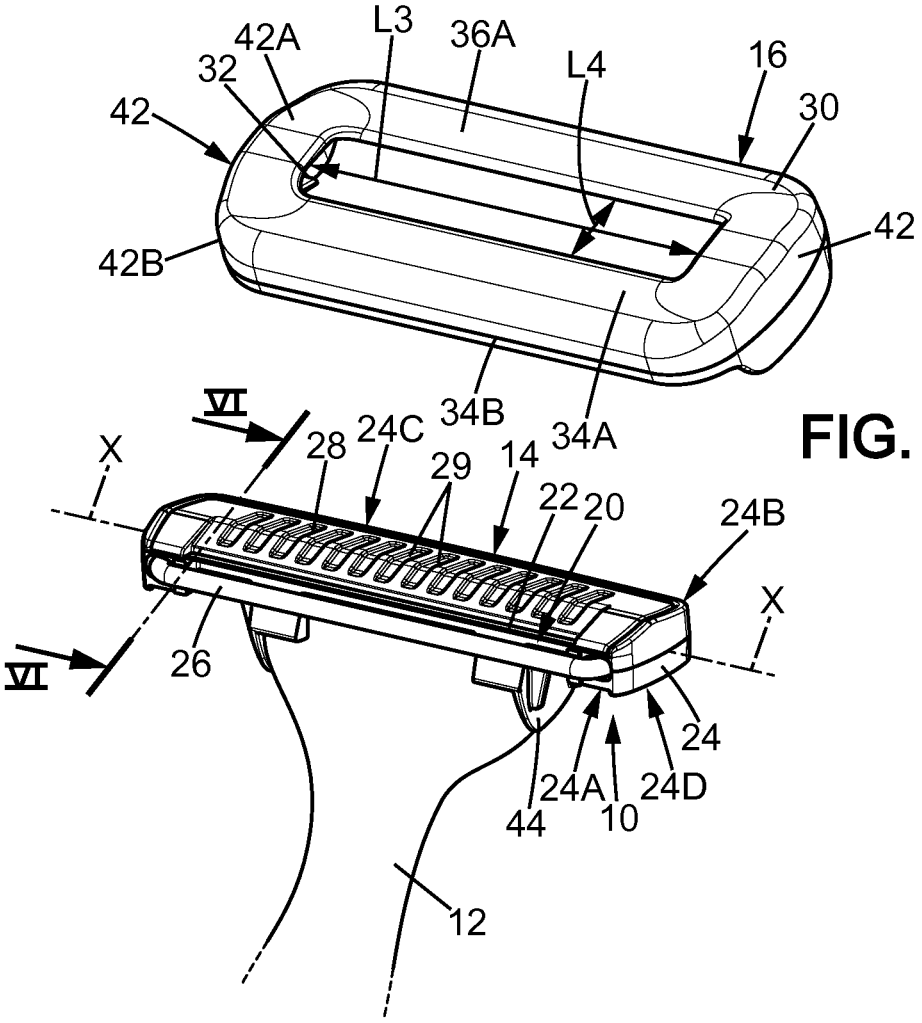
FIG. 1B is a perspective view partially exploded of a razor according to another aspect of the disclosure.
Figure 1C:
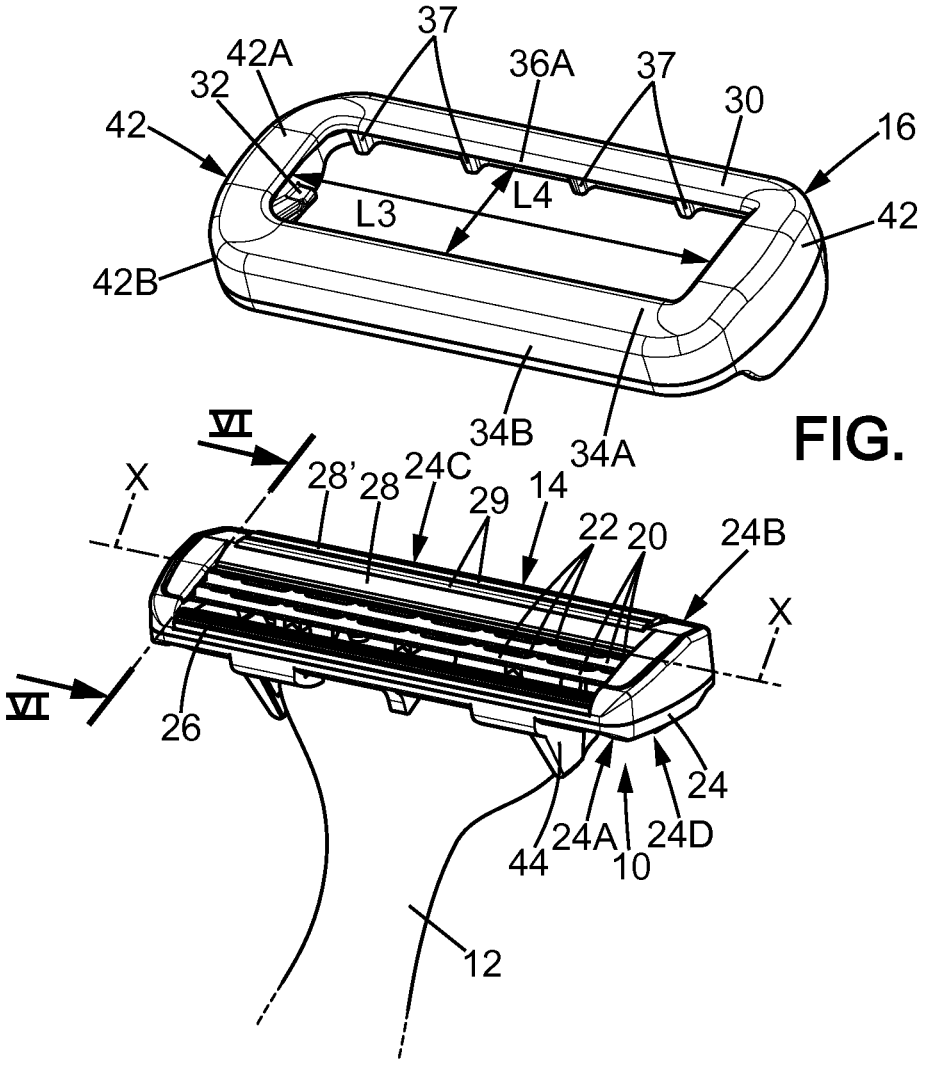
FIG. 1C is a perspective view partially exploded of a razor according to yet another aspect of the disclosure.
Figure 1D:
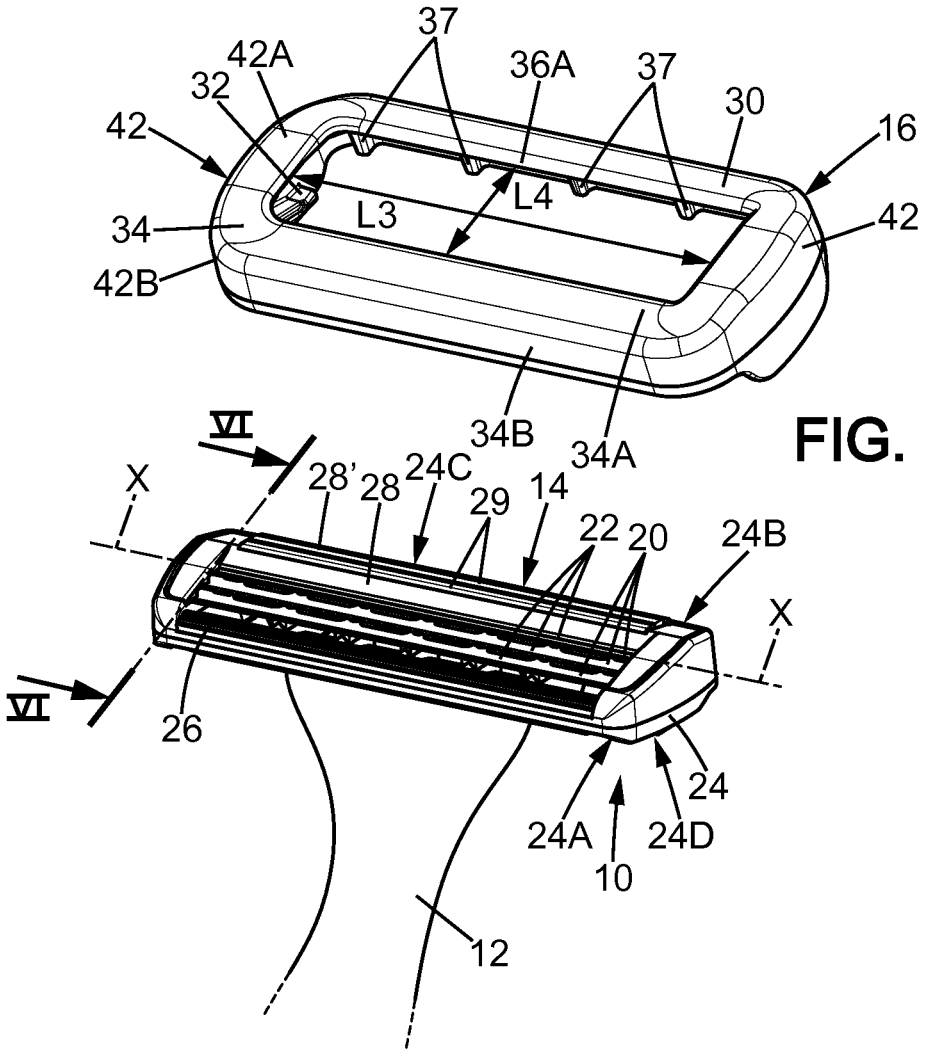
FIG. 1D is a perspective view partially exploded of a razor according to a further aspect of the disclosure.
Figure 2A:
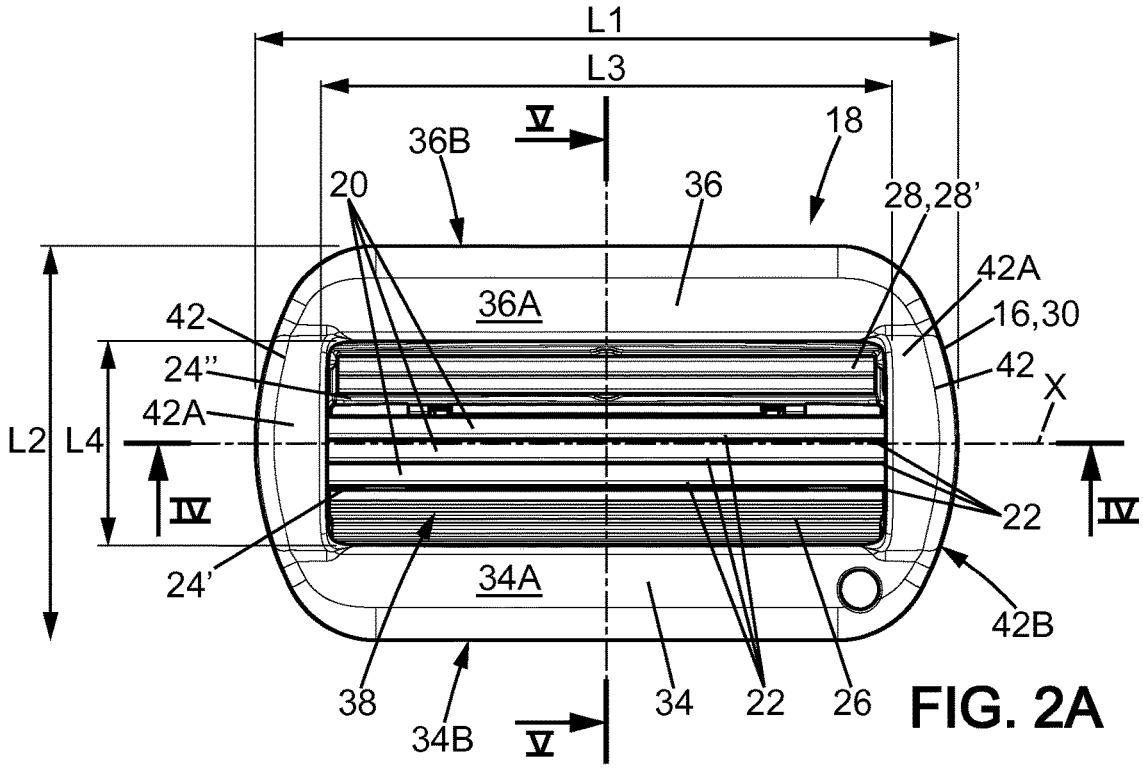
FIG. 2A is a front view of the shaving blade assembly according to FIG. 1A, with the skin contact member attached to the blade unit.
Figure 2B:
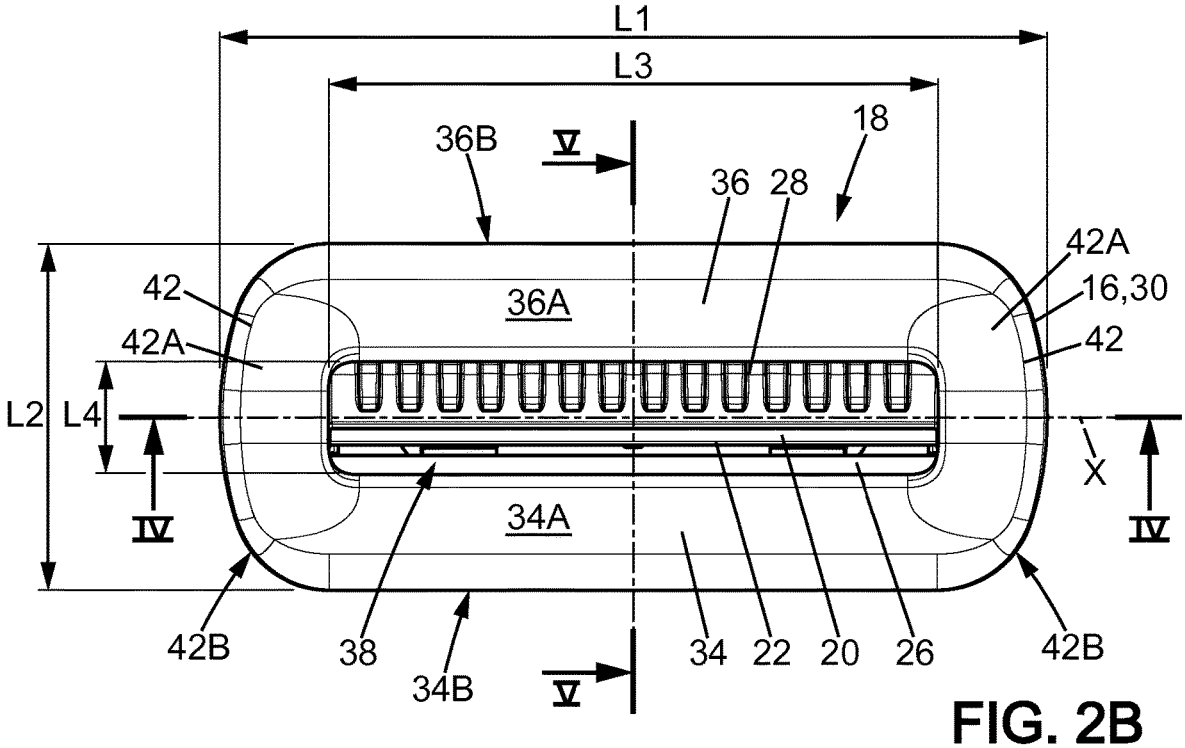
FIG. 2B is a front view of the shaving blade assembly according to FIG. 1B, with the skin contact member attached to the blade unit.
Figure 2C:
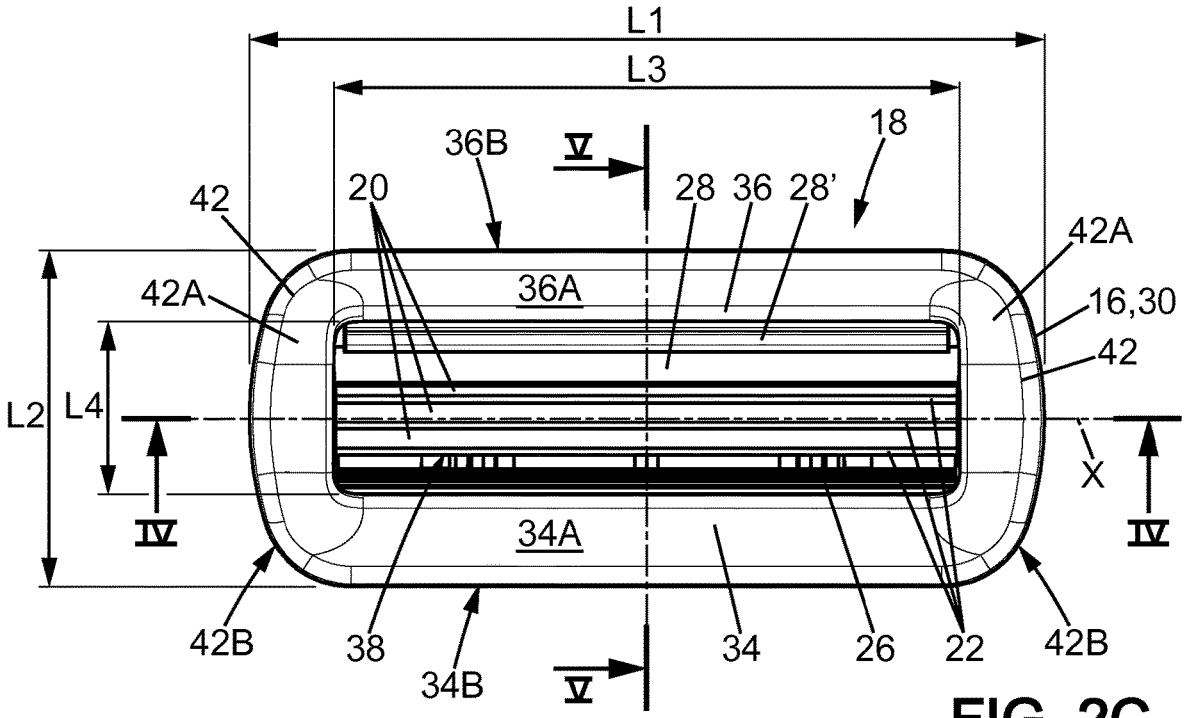
FIG. 2C is a front view of the shaving blade assembly according to FIG. 1C, with the skin contact member attached to the blade unit.
Figure 2D:
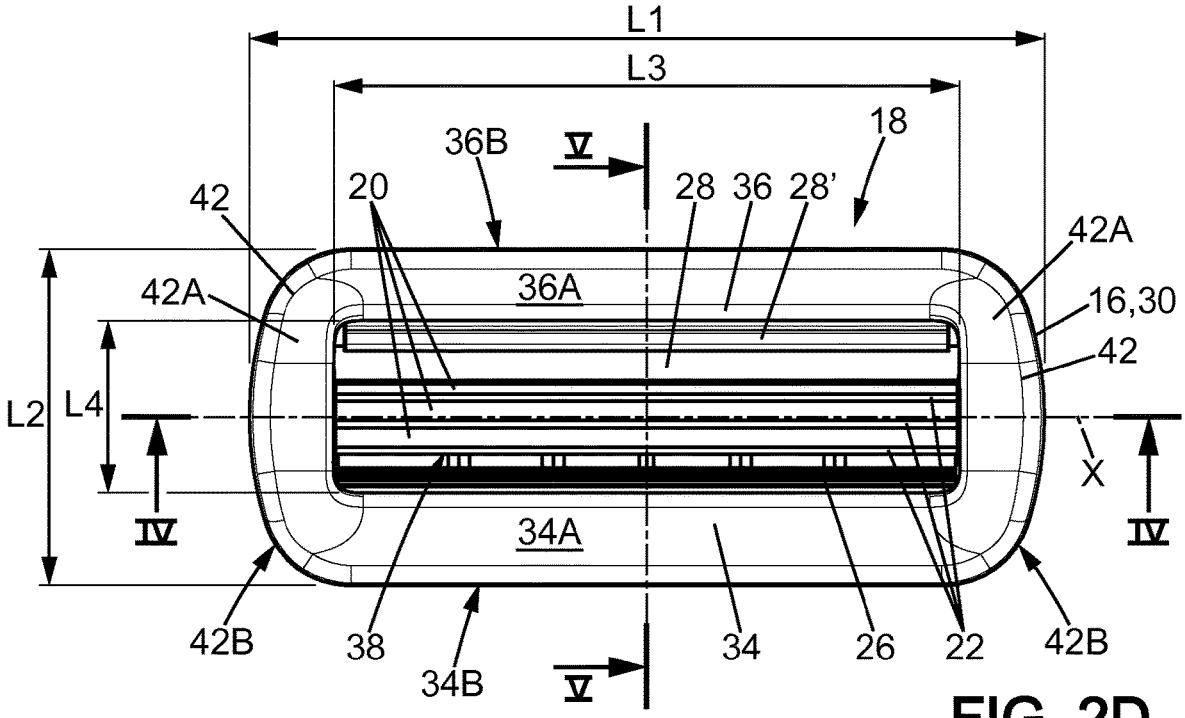
FIG. 2D is a front view of the shaving blade assembly according to FIG. 1D, with the skin contact member attached to the blade unit.

The number of shaving blades 20 may include, for example, between one and five and according to some aspects may include three or four blades. FIGS. 1A, 1C and 1D illustrate a blade unit 14 including three blades, whereas FIG. 1B illustrates a blade unit 14 including one blade.

The housing 24 may be elongated, extending along a longitudinal axis X-X.

A guard bar 26 and a cover 28 may be disposed on the upper face 24C of the housing 24, respectively in front (i.e. forward) the shaving blades 20 and aft of the shaving blades (i.e. rearward or back). When the blade unit includes several blades 20, the forward the blade edge 22 indicates forward the forward-most blade edge and rearward indicates rearward the rearward-most blade edge.

The cover 28 may include a shaving aid, commonly named lubra 28' (such as a lubricant, a moisturizer, a conditioner and/or an exfoliant) as depicted on FIGS. 1A, 1C and 1D. The cover 28 may not include a shaving aid, as depicted on FIG. 1B. Accordingly, the cover 28 may be provided with longitudinal ribs (not depicted) or with grooves 29 extending transversally to the longitudinal axis X-X.

As depicted in FIGS. 1A, 1C and 1D, the guard bar 26 may include an elastomeric material which may include longitudinal fins. The longitudinal fins may be parallel to the longitudinal axis X-X. As shown in FIG. 1B, the guard bar 26 may include a wire extending longitudinally. The wire may extend parallel to the longitudinal axis X-X. The guard bar 26 may formed from a metal.

As best seen in FIGS. 1A to 1D, the cutting edge 22 of each shaving blades 20 may extend longitudinally along the longitudinal axis X-X toward the guard bar 26.

Figure 5A:
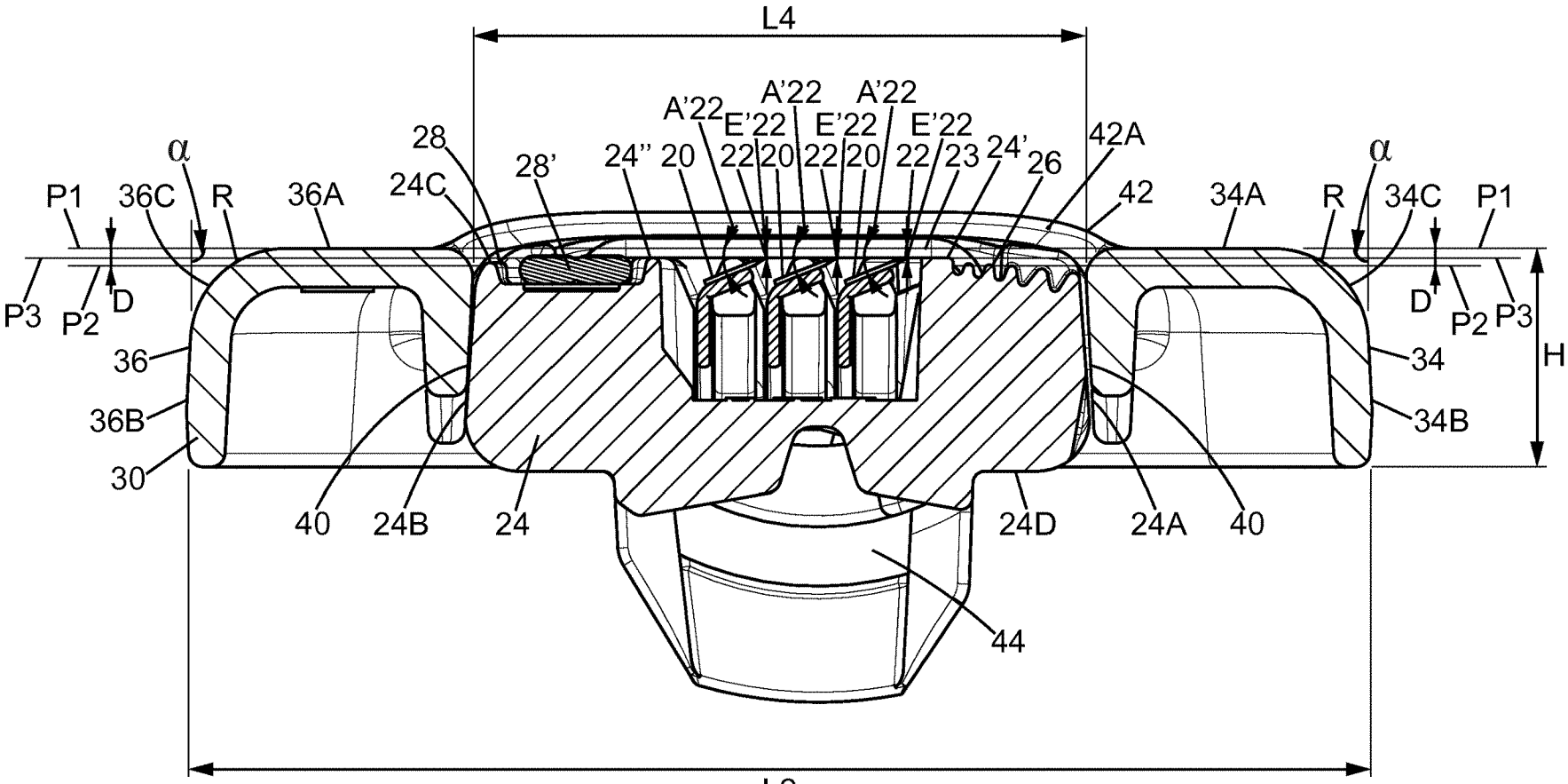
FIG. 5A is a transverse sectional view of the skin contact member of FIG. 2A line V-V.
Figure 5B:
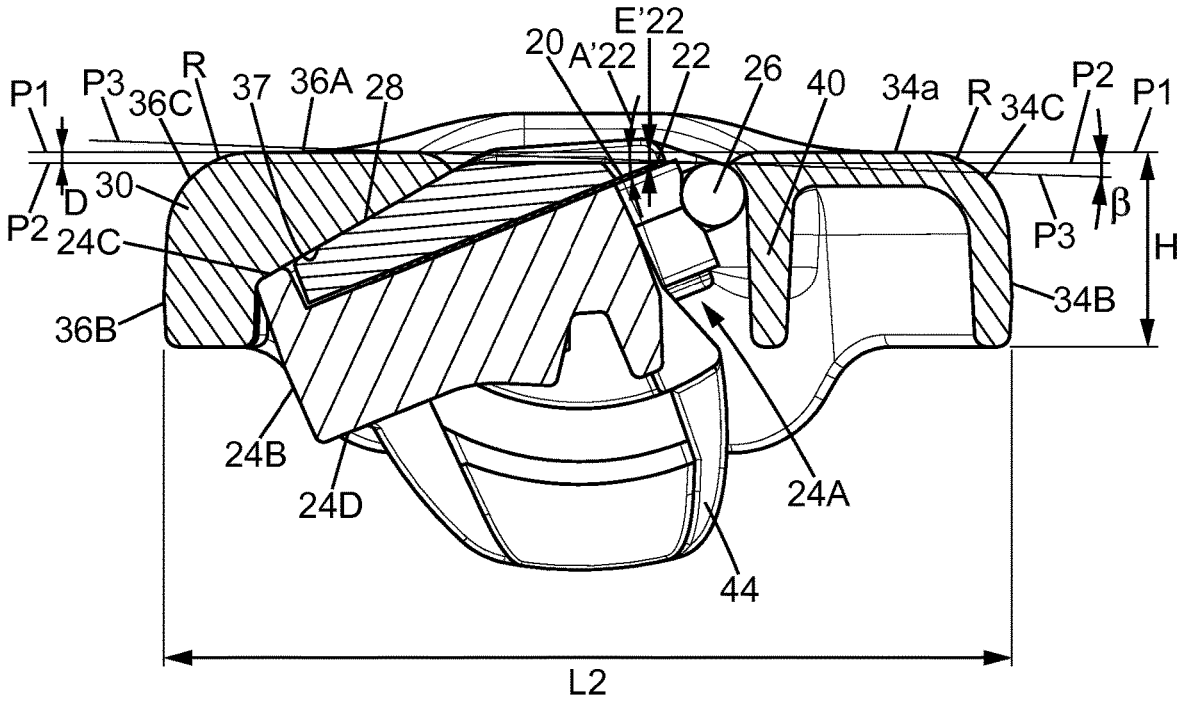
FIG. 5B is a transverse sectional view of the skin contact member of FIG. 2B line V-V.
Figure 5C:
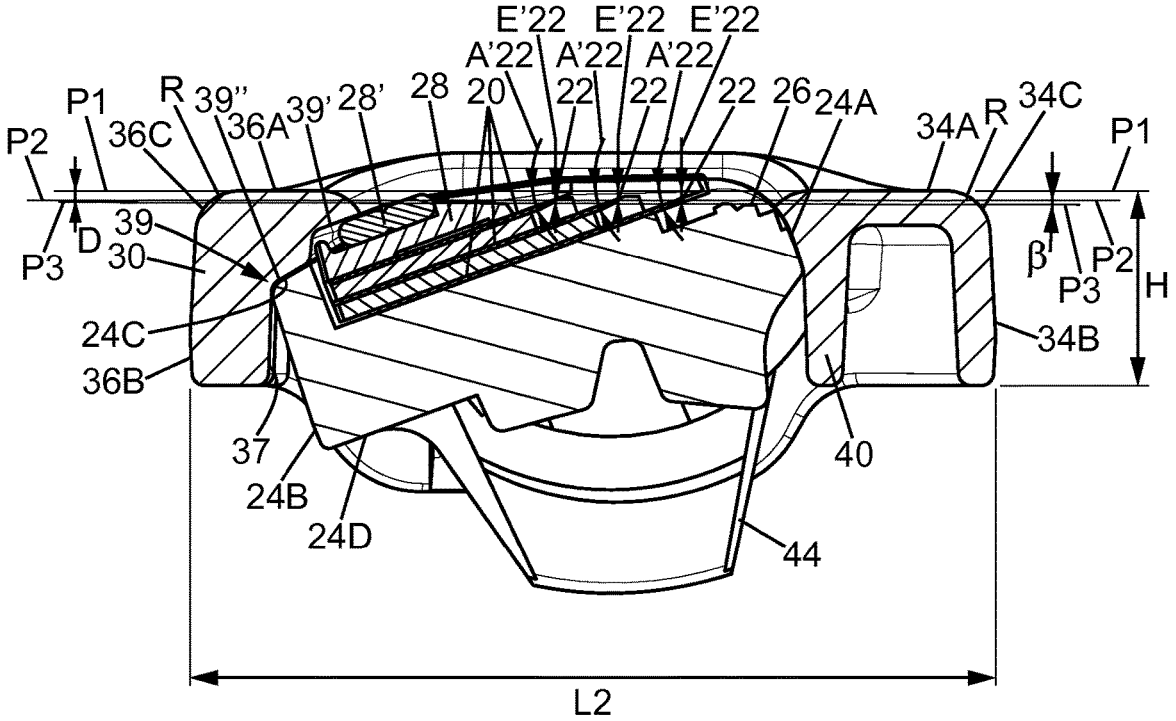
FIG. 5C is a transverse sectional view of the skin contact member of FIG. 2C line V-V.
Figure 5D:
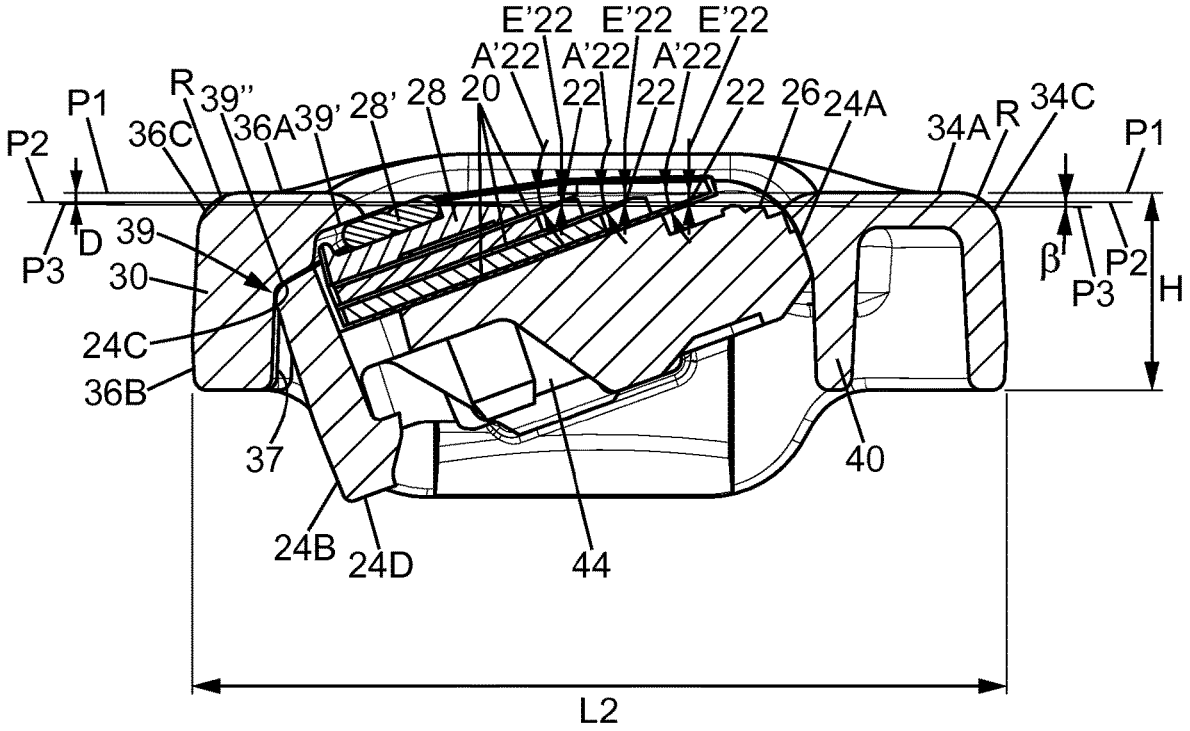
FIG. 5D is a transverse sectional view of the skin contact member of FIG. 2D line V-V.

The housing 24 may further include a first part 24' located forward the blade edge 22 and a second part 24" located rearward the blade edge 22. As shown in FIG. 5A, when the housing 24 is provided with a guard bar 26, the first part 24' may be located between the forward-most blade edge 22 and the guard bar 26. Similarly, when the blade unit 24 is provided with a lubra 28, the second part 24" may be located between the rearward-most the blade edge 22 and the lubra 28. Both the first part 24' and the second part 24" may each be reduced to a point or even may be non-existent, as shown in FIGS. 5B to 5D.

The skin contact member 16 may be a separate member provided on a frame 30 and thus may be attachable to the blade unit 14.

According to an aspect, the connecting means, the connection between the razor handle 12 and the shaving blade assembly 18 may be fixed or pivotable. FIGS. 1A to 1C illustrate pivoting shaving blade assemblies 18, whereas FIG. 1D illustrates a fixed shaving blade assembly 18. The skin contact member 16 and thus the frame 30 may be specifically adapted to the housing 24. For example, FIGS. 1A to 1C illustrate three different skin contact members 16 (and thus frames 30). FIG. 1D illustrates the same skin contact member 16 as the skin contact member 16 depicted in FIG. 1C. The shaving blade assembly 18 of FIG. 1C is pivotable, whereas on FIG. 1D it is fixed.

The skin contact member 16 may frictionally receive the blade unit 14 such that the skin contact member 16 may be mounted and naturally maintained in the blade unit 14. As such, the frame 30 of the skin contact member 16 may be designed to cooperate with friction with the housing 24 of the blade unit 14.

The skin contact member 16 may also be elastically mounted on the blade unit 14. For example, the frame 30 of the skin contact member 16 may deform elastically during connection to the blade unit 14. Hence, the elasticity of the frame 30 may be higher than that of the shaving housing 24.

The friction forces and the elasticity of the skin contact member, after mounting, may allow the skin contact member 16 to be permanently connected to the blade unit 14 or, in some aspects, releasably (i.e. detachably) connected to the blade unit 14. When the skin contact member 16 is releasably connected to the blade unit 14, the friction between the skin contact member 16 and the blade unit 14 may be such that the skin contact member 16 may be maintained on the blade unit 14 thereby allowing a user to shave without any risk of detachment. Moreover, the voluntary release/detachment of the skin contact member 16 from the blade unit 14 may be facilitated without using a significant force. For example, separation of the skin contact member 16 from the blade unit 14 may be obtained without the help of any tool.

According to some aspects, the skin contact member 16 may be motionless when secured to the blade unit. The skin contact member 16 may, for example, be snap-fitted to the blade unit 14. As best seen on FIGS. 3A-3C and 4A-4D, one or more protrusions 32 may be provided on the frame 30 to allow the firm attachment of the skin contact member 16 onto the blade unit 14 after the snap-fitting occurred. Thus, when attached to the housing 24, the skin contact member 16 may not be able to move and/or deflect with respect to the housing 24.

The skin contact member 16 may surround the blade unit 14, but the present disclosure may not be limited to this geometry.

The skin contact member 16 may include a leading skin contact part 34 extending in front of the shaving blades 20 and a trailing skin contact part 36 extending rearward of the shaving blades 20. More precisely, the leading skin contact part 34 may be located in front of the forward-most blade and the trailing skin contact part 36 may be located aft of the aft-most blade 20 (when the skin contact member 16 is mounted on the blade unit 14). The skin contact member 16 further include thermochromic pigments. Thermochromic pigments may be used to pass information to the user. For example, the pigments may allow the skin contact member 16 to be a blue color when the skin contact member 16 is too cold for improving a shave. The pigments may allow the skin contact member 16 to be red in color when the skin contact member 16 is too hot for improving a shave thereby increasing the risk of a burn. The pigments may allow the skin contact member 16 to be pink in color when the skin contact member 16 is ready for use. The pigments provided on the skin contact member 16, by being able to change color, may give indications to the user for readiness of use, according to the temperature of the skin contact member 16.

As best seen in FIGS. 5A to 5D, the leading skin contact part 34 may include a leading surface 34A and the trailing skin contact 36 may include a trailing surface 36A, the leading surface 34A and the trailing surface 36A may define a contact plane P1 tangent to the leading 34A and the trailing 36A surfaces.

According to some aspects, the leading surface 34A may be planar. The trailing surface 36A may also be planar. When both the leading surface 34A and the trailing surface 36A are planar, the leading planar surface 34A and the trailing planar surface 36A may be included in the contact plane P1.

Figure 6A:
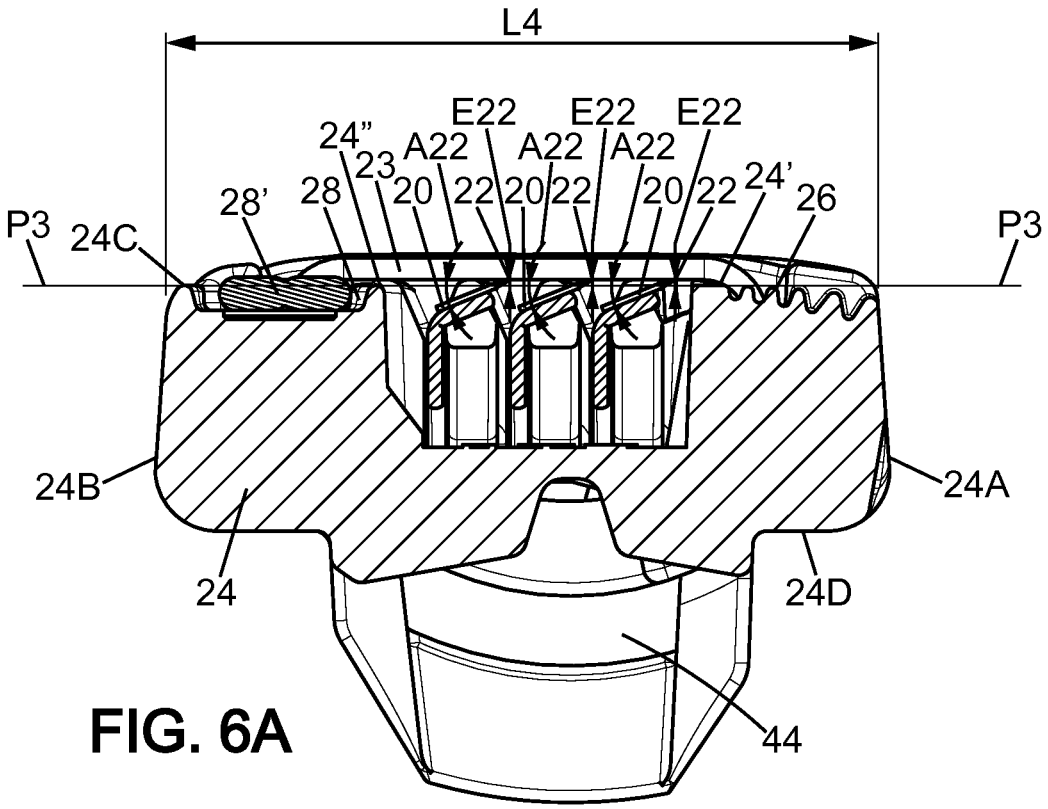
FIG. 6A is a transverse sectional view of the blade unit of FIG. 1A along line VI-VI.
Figure 6B:
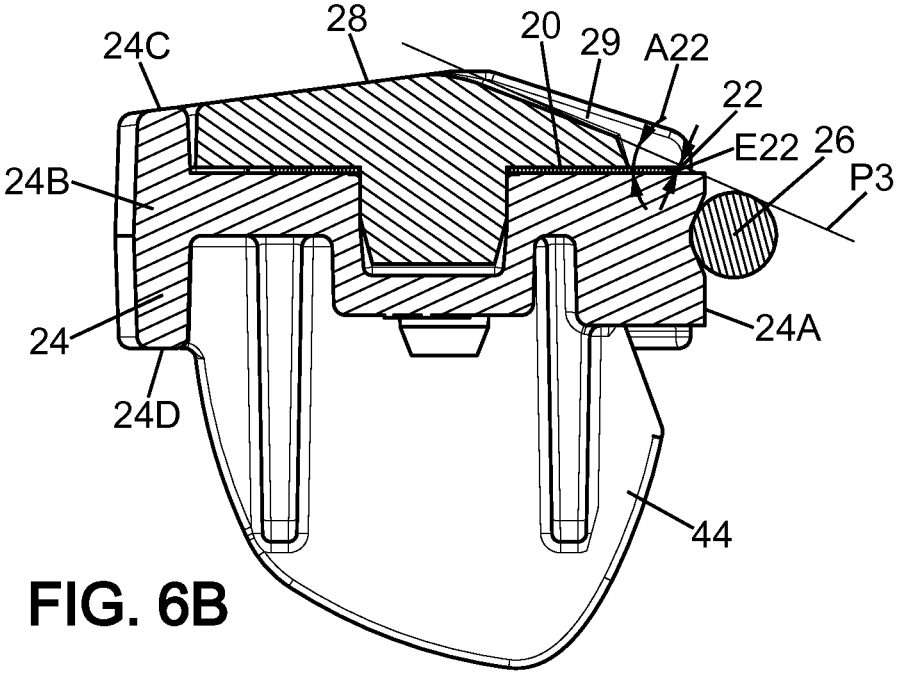
FIG. 6B is a transverse sectional view of the blade unit of FIG. 1B along line VI-VI.
Figure 6C:
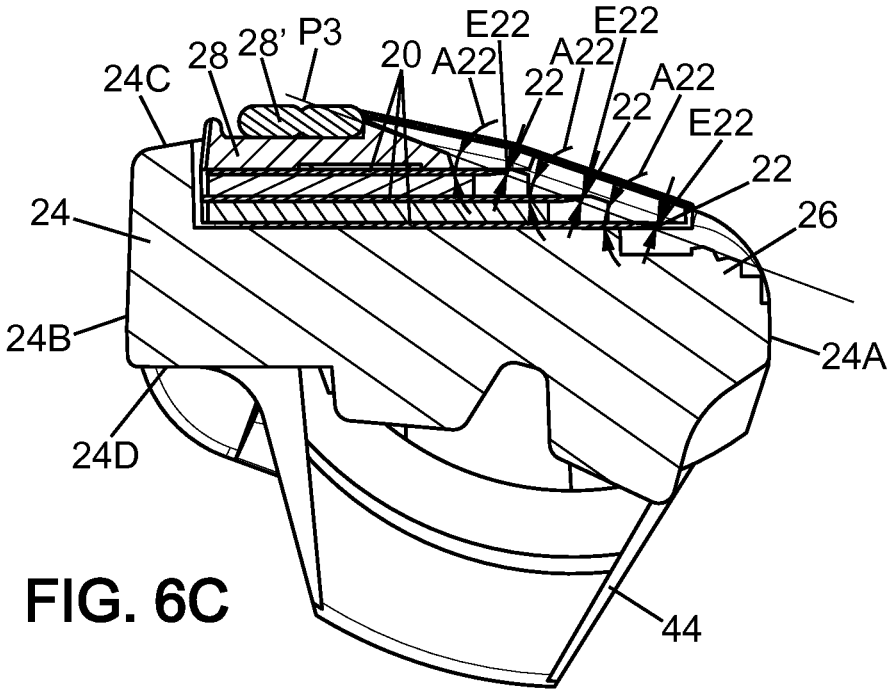
FIG. 6C is a transverse sectional view of the blade unit of FIG. 1C along line VI-VI.
Figure 6D:
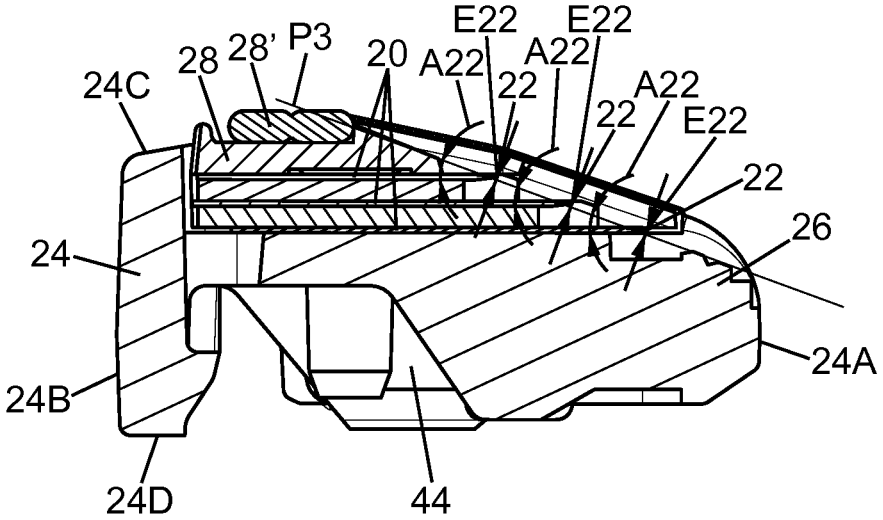
FIG. 6D is a transverse sectional view of the blade unit of FIG. 1D along line VI-VI.

According to an aspect as detailed in FIG. 6A, the first part 24' and the second part 24" of the housing 24 may define a blade unit P3. In other words, the blade unit plane P3 may be tangent to the first part 24' and the second part 24" of the housing 24. When one of the first part 24' or the second part 24" of the housing 24 is reduced to a line, the blade unit plane P3 may be the plane tangent to thereto, as shown in FIGS. 6B to 6D. The blade unit plane may thus be tangent to the guard bar 26 and the cover 28 of the blade unit 14. When the blade unit 14 is not connected to the skin contact member 16, the blade unit plane P3 may correspond to the shaving plane. The blade unit 14 may be used for shaving without being connected to the skin contact member 16. As such, the shaving plane may correspond to the blade unit plane P3.

As detailed hereafter, the shaving plane may be different from the blade unit plane P3 when the blade unit 14 is used for shaving when connected to the skin contact member 16.

The leading skin contact part 34 may further include a leading longitudinal face 34B which is may be connected to the leading planar surface 34A via a leading curved face 34C. In a same way, the trailing skin contact part 36 may further include a trailing longitudinal face 36B which may be connected to the trailing planar surface 36A via a trailing curved face 36C.

The leading longitudinal face 34B may be perpendicular to the leading planar surface 34A and may extend longitudinally to the longitudinal axis X-X in front of the housing 24. More precisely, the leading longitudinal face 34B may extend in front of the front edge 24A of the housing 24.

The trailing longitudinal face 36B may also be perpendicular to the trailing planar surface 36A and may extend longitudinally to the longitudinal axis X-X rearward of the housing 24. More precisely, the trailing longitudinal face 36B may extend in front of the rear edge 24B of the housing 24.

Each longitudinal face (leading 34B and trailing 36B) may be connected to the respective planar surface (leading 34A and trailing 36A) by a curved face (leading 34C and trailing 36C). Both leading curved face 34C and trailing curved face 36C may have a radius of curvature R between 1 mm and 3 mm. According to some aspects, the radius of curvature may be about 2 mm.

The frame 30 may be symmetric or mat not be symmetric with respect to the longitudinal axis X-X. In other words, the respective planar surface (leading 34A and trailing 36A) may be of a different dimension. The interior of the frame may be different structurally, as detailed hereafter, between the part located in front of the blade edges and the part located aft the blade edges. According to an aspect as shown in FIGS. 5A and 5B, the respective planar surface (leading 34A and trailing 36A) may be of a same dimension and surface, whereas in FIGS. 5C and 5D, the trailing planar surface 36A may be smaller than the leading planar surface 34A. Aspects of FIG. 5A may be symmetric with respect to the longitudinal axis X-X, whereas the other aspect may not.

As best seen in FIGS. 3A-3C and 5A-5D, the frame 30, including the skin contact member 16 may, as already mentioned above, be a separate element connected to the blade unit 14 and may surround the blade unit 14 as depicted on the drawings. As such, the frame 30 may include an opening 38 through which the cutting edges 22 may be accessible when mounted on the blade unit. The opening 38 may be shaped to fit the housing 24. More precisely, the frame 30 may include an inner wall which may have at least one lateral part 40.

Figure 3A:
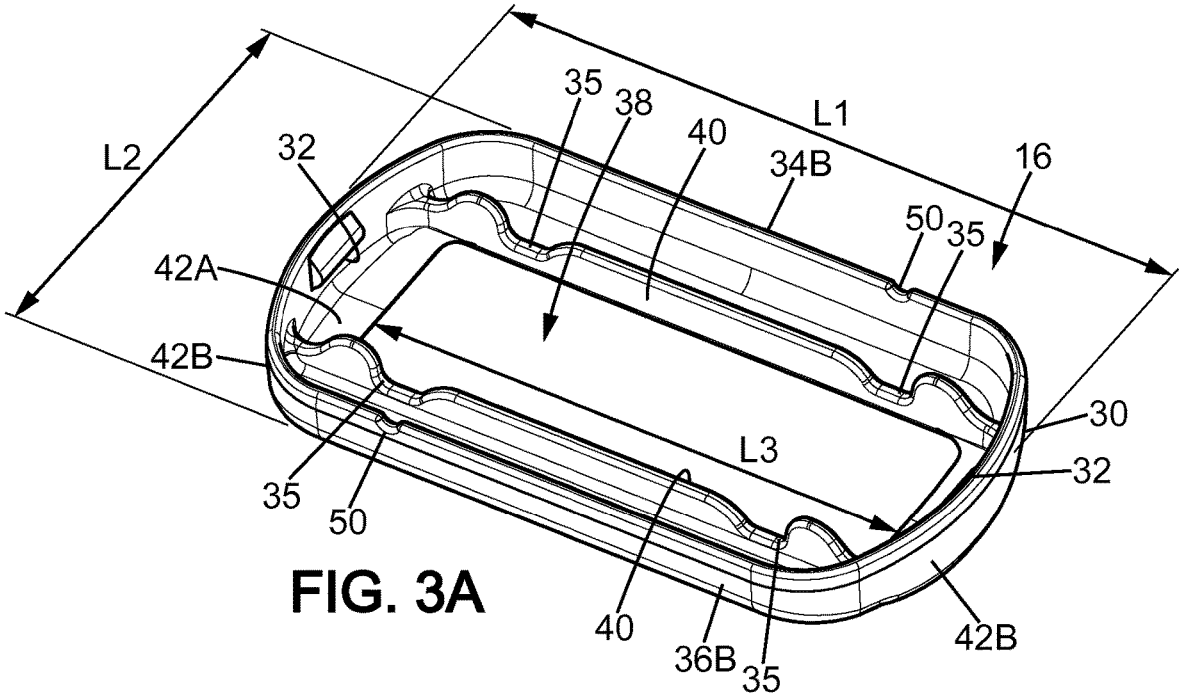
FIG. 3A is a perspective view of the skin contact member of FIG. 1A.

As depicted in FIG. 3A, the frame 30 may be provided with two lateral parts 40 cooperating respectively with the front edge 24A and the rear edge 24B of the housing. The frame 30 may connected to the blade unit 14 the two lateral parts cooperating with the front edge 24A and a rear edge 24B of the housing 24, as seen in FIG. 5A.

According to other aspects (see FIGS. 3B and 3C), the frame 30 may be provided with only one lateral part 40 cooperating respectively with the front edge 24A. The frame 30 may be connected to the blade unit 14 the lateral part cooperating with the front edge 24A, as seen in FIGS. 5B, 5C and 5D.

The frame 30 may further include two transverse parts 42 connecting the leading skin contact part 34 and the trailing skin contact 36 on either side of the blade unit 14.

Each transverse part 42 may include a transverse surface 42A encasing a part of the upper face 24C of the housing 24 and the lateral face 42B. The transverse surface 42A may be connected to the lateral face 42B via a curved face 42C having a radius curvature R which may be about 2 mm. The transverse surfaces 42A may be shaped such that they fit onto the upper face 24C. When the blade unit 14 as depicted on FIG. 1A is provided with clips 23, the transverse surfaces 42A May be shaped such that they fit onto and over the clips 23.

Figure 3B:
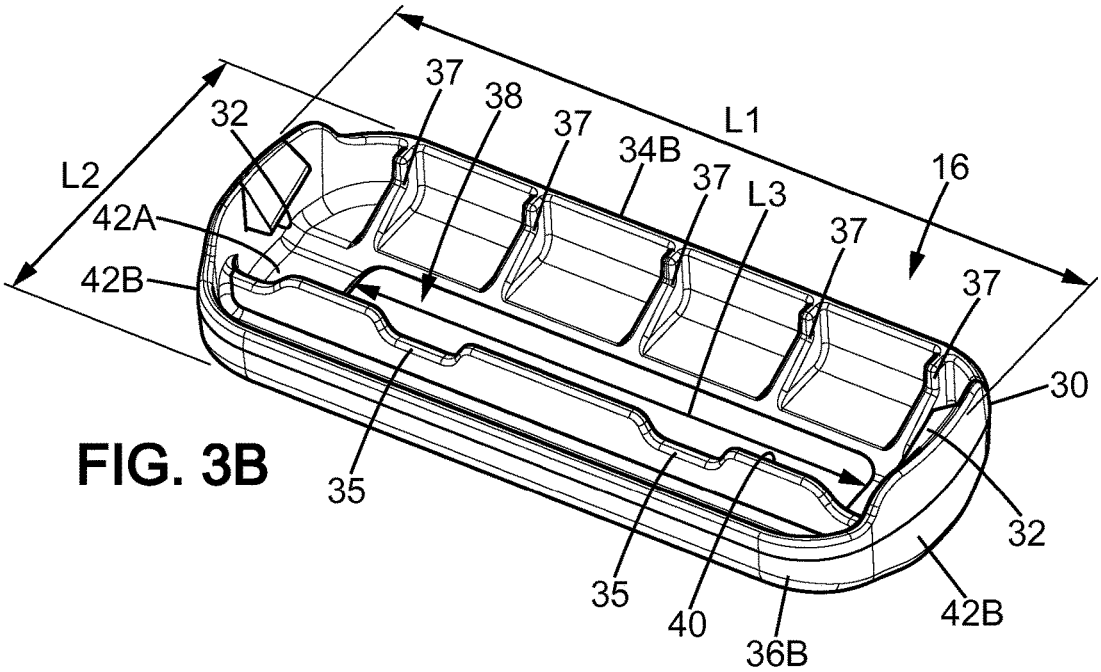
FIG. 3B is a perspective view of the skin contact member of FIG. 1B.
Figure 3C:
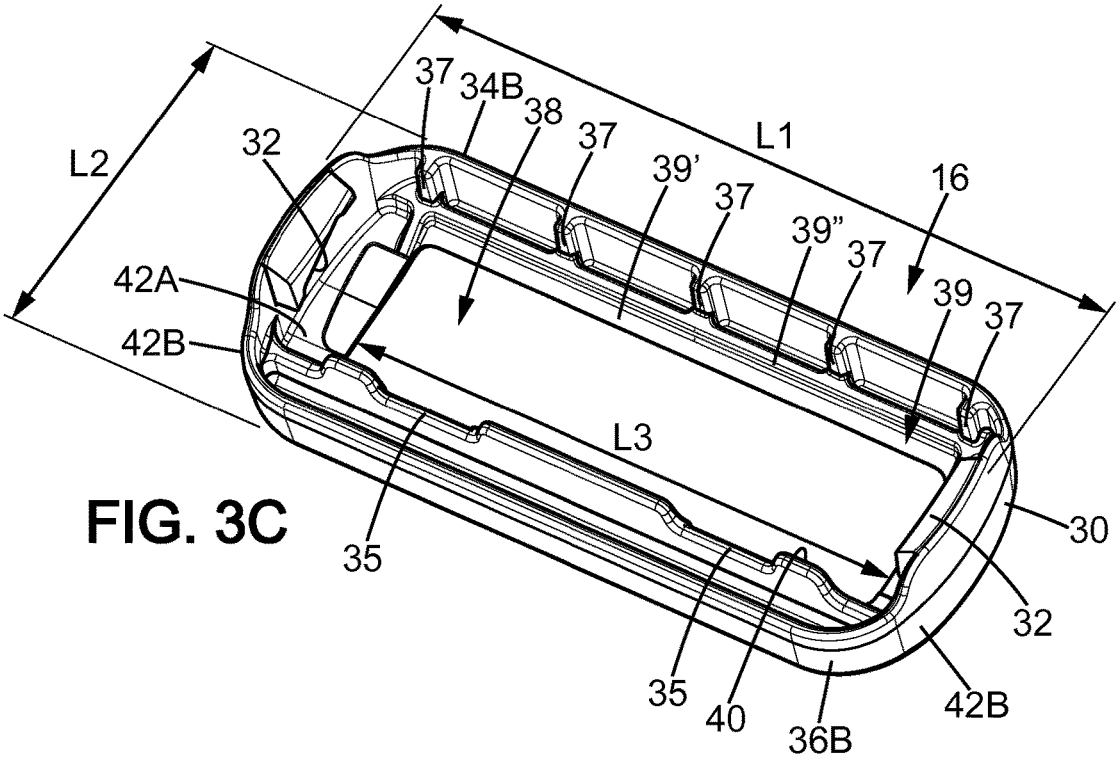
FIG. 3C is a perspective view of the skin contact member of FIG. 1C.

The lateral faces 42B, the leading longitudinal face 34B and the trailing longitudinal face 36B are connected in order to form a peripheral wall of the frame 30. The peripheral wall may encase the housing 24. The peripheral wall may be provided with rounded corners between each of lateral faces 42B and respective leading longitudinal face 34B and trailing longitudinal face 36B, as best seen in FIGS. 3A-3C.

When the blade unit 14 is attached to the skin contact member 16, the shaving blade assembly 18 may have an assembly plane P2. The assembly plane P2 may correspond to a plane which is parallel to the contact plane P1 and which is tangent to the aft-most blade edge 22 (i.e. the blade edge 22 that is the farest from the guard bar 26). In other words, the assembly plane P2 may be the plane tangent to the aft-most blade edge and may be distant from the contact plane P1 by a distance D.

According to an aspect where a blade unit 14 includes a single blade 20, one the assembly plane P2 which is the plane parallel to the contact plane P1, is tangent to the blade edge 22 of the single blade 20.

The geometry of the frame 30, especially its lateral part(s) 40 and its transverse surfaces 42A, taken in combination with the protrusions 32, may lead to an improvement of the mounting and maintaining of the frame 30 on the housing and thus may lead to a better control of the distance D between the contact plane P1 and the assembly plane P2, as best shown on FIGS. 5A-5D.

The protrusions 32 may be located anywhere on the frame 30 such that the protrusions 32 may contact the housing 24. As shown in FIGS. 3A-3C and 4A-4D, two protrusions 32 may be provided on the inner side of the frame 30, between the lateral parts 40, and may be laterally opposed to each other on a lateral face 42B of the frame 30. The protrusions 32 may be configured to contact the housing 24.

Figure 4A:
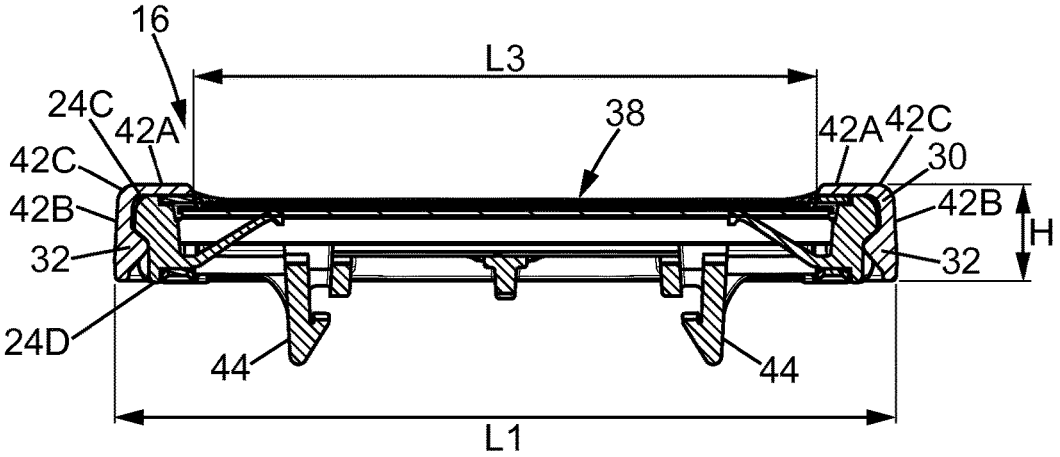
FIG. 4A is a longitudinal sectional view of the skin contact member of FIG. 2A along line IV-IV.
Figure 4B:
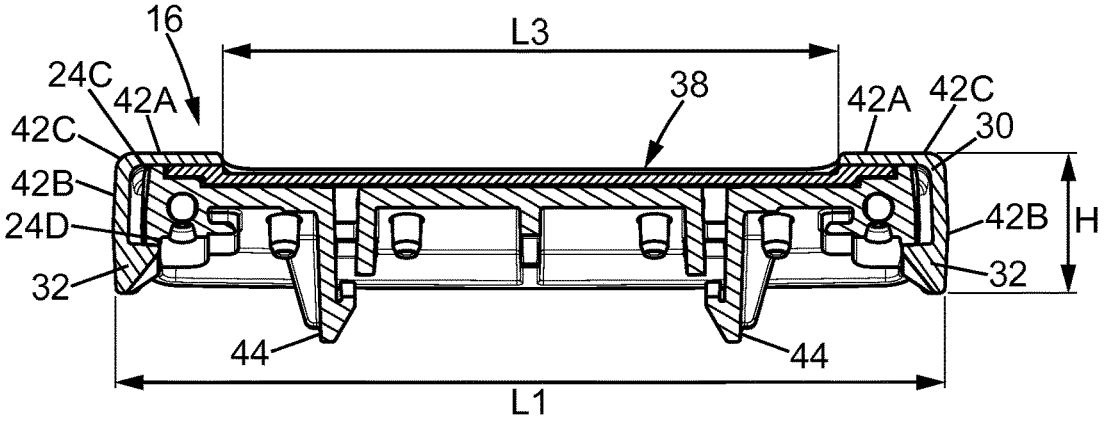
FIG. 4B is a longitudinal sectional view of the shaving blade assembly of FIG. 2B along line IV-IV.
Figure 4C:
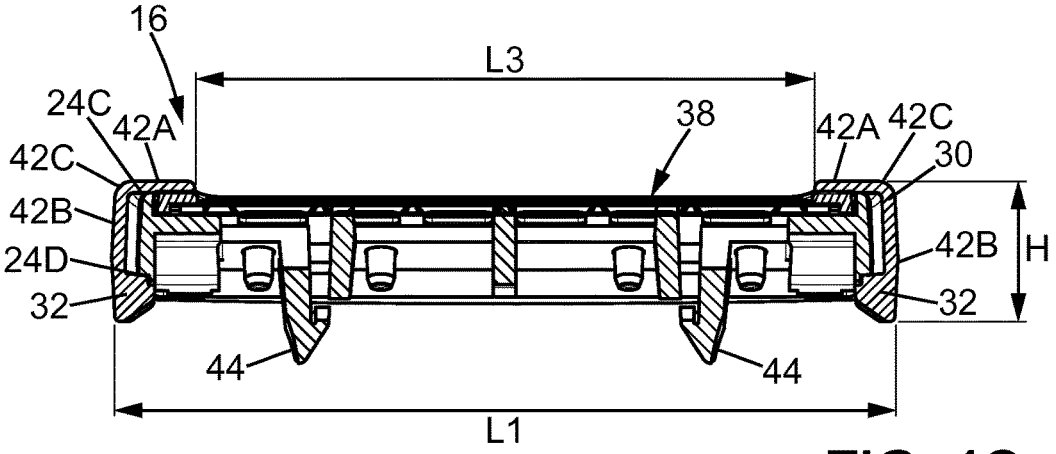
FIG. 4C is a longitudinal sectional view of the shaving blade assembly of FIG. 2C along line IV-IV.
Figure 4D:
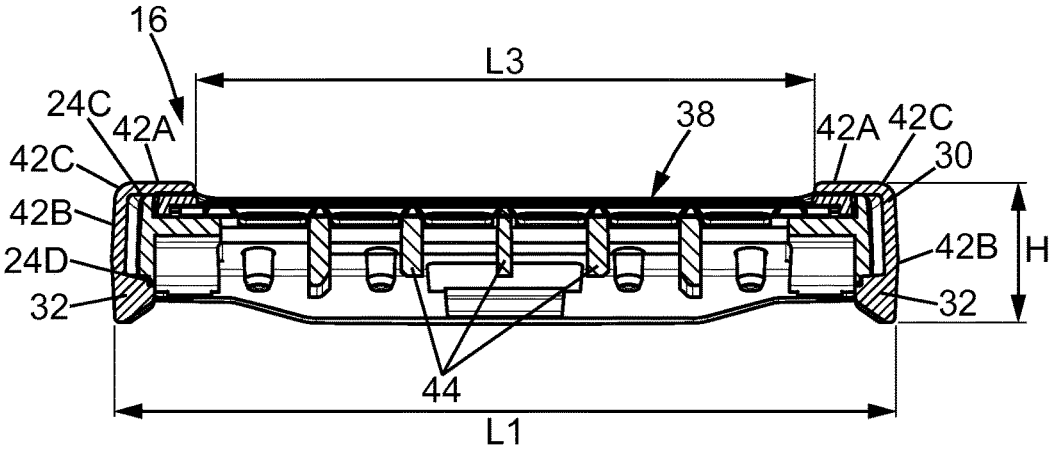
FIG. 4D is a longitudinal sectional view of the shaving blade assembly of FIG. 2D along line IV-IV.

According to some aspects, and as depicted in FIGS. 1A and 4A, the protrusions 32 may be configured to contact recesses 33 provided on the housing 24. According to other aspects, (see FIGS. 1B-1D and corresponding FIGS. 4B-4D), the protrusions 32 may be configured to contact the lower face 24D of the housing 24. The protrusions 32 may be similar to hooks that fit under the housing 24. The protrusions 32 may thus have a corresponding shape for receiving the housing 24. As detailed hereafter, the housing 24 may be received in the frame 30 in an inclined manner. As such, the part of the protrusions 32 that cooperate with the housing 24 may be correspondingly inclined, as best visible on shown in FIGS. 3A and 3C.

As shown in FIG. 3A, the frame 30 may be provided with two lateral parts 40 cooperating with the front 24A rear 24B edges of the housing 24. According to other aspects, including only one lateral part 40 (see FIGS. 3B-3C), the skin contact member 16 may include ribs 37 for improving the attachment of the blade unit 14 and the frame 30. The ribs 37 may be disposed on at least one of the lateral faces 42B.

The inclination of the ribs 37 may allow for an inclination of the housing 24 in the frame 30. The shape of the ribs 37 may be adapted to the shape of the housing 24 and to the change of blade angle expected when the blade unit 14 is connected to the skin contact member 16 as explained in details hereafter.

According to a further aspect, as best seen in FIGS. 3A-3C, the skin contact member 16 may be provided with cut-outs 35 for stabilizing the blade unit 14 during the assembly process of the frame onto the blade unit 14. The cut-outs may be located on at least one of the lateral parts 40.

According to one aspect, as shown in FIG. 3A, the frame 30 may be provided only with cut-outs 35 and may not be provided with ribs. A first pair of cut-outs 35 may be provided on a first lateral part 40 and a second pair may be provided opposite to the first pair, on the opposite lateral part 40.

The frame 30 may include cut-outs 35 and ribs 37. The cut-outs 35 may be disposed on a lateral part 40 and ribs 37 may be disposed on one of the leading longitudinal face 34B or trailing longitudinal face 36B, opposite to the lateral part 40. According to some aspects, as shown in FIGS. 3B and 3C, a pair of cut-outs 35 may be located on a lateral part 40 (near the leading longitudinal face 34B) and several ribs 37 may be located on the trailing longitudinal face 36B, opposite to the lateral part 40.

As shown in FIGS. 6A to 6D, the blade edge 22 of each of the blades 20 provided in the housing 24 may have an exposure which is positive, negative or null (equal to zero) with regard to the blade unit plane P3.

The blade unit 14 may be used for shaving without the skin contact member 16. However, in order to improve the shave and change the glideness and/or the inclination of the blades 20 and the blade edge 22, the blade unit 14 may be attached to the skin contact member 16.

As detailed above, when the blade unit 14 is attached to the skin contact member 16, the shaving blade assembly may have an assembly plane P2. As best seen in FIGS. 5A to 5D, the blade edge 22 of each of the blades 20 provided in the housing 24 may have an exposure which is positive, negative or null (equal to zero) with regard to said assembly plane P2. The same appears with regard to the blade unit plane P3 (see FIGS. 5A to 5D). However, this does not indicate that the blade has the same exposure with regard to the assembly plane P2 and with regard to the blade unit plane P3. According to the exposure of the aft-most blade edge 22, the assembly plane P2 may thus be above, under or coincide with the contact plane P1.

When the blade unit 14 is provided with several blades 20, the exposure of the blade edges 22 may be progressively continuous, increasing and/or decreasing from one blade to the other with regard to the assembly plane P2 or with regard the contact plane P1. The same appears with regard to the blade unit plane P3 (see FIGS. 5A to 5D). However, this does not indicate that when considering one of the blades 20, that the blade 20 has the same exposure with regard to the assembly plane P2 and with regard to the blade unit plane P3. In addition, the increase/decrease or continuity of the blade exposure might be different with regard to the contact plane P1 and with regard to the blade unit plane P3. For example, blade 20 may include a first blade exposure E22 with regard to the blade unit plane P3 and may have a second different blade exposure E'22 with regard to contact plane P1.

The assembly plane P2 may be above or respectively below the contact plane P1, when the blade exposure of at least the aft-most blade 20 is positive or respectively negative with regard to the contact plane P1. The blade exposure of each of the blades 20 may be positive or respectively negative with regard to the contact plane P1, when each of the blade edges 22 are above the contact plane P1 or respectively under the contact plane P1.

The assembly plane P2 and the contact plane P1 may coincide when the exposure of the blades is equal to zero with regard to the contact plane P1. When the blades 20 are movable, the exposure may be given in the rest position.

When connected onto the blade unit 14, the contact plane P1 of the skin contact member 16 may be parallel to and above the assembly plane P2. For example, the distance D between the contact plane P1 and the assembly plane P2 may be between 0.2 mm and 0.6 mm and according to one aspect, may be about 0.3 mm. In other words, the blade edges 22 may be located underneath the contact plane P1; this may lead to an improvement in the shave and reduced risk of inadvertently cutting the skin when the user shaves. A distance D, greater than 0.6 mm, may lead to reduced closeness, whereas a distance D smaller than 0.2 mm, may reduce the efficiency of the skin contact member 16. As such, the blade edges 22 may have a positive exposure with regard to the blade unit plane P3, whereas the blade edges 22 may in turn have a negative exposure with regard to the contact plane P1. The second blade exposure E'22 may be equal, greater or smaller than the first blade exposure E22.

According to the blade exposure defined above with regard to the assembly plane P2, the blade edge 22 of each blade 20 may be above, below or tangent to the contact plane P1.

In relation to the way the blade unit and the skin contact member are attached together, the blade angle may also change. Generally, a blade 20 may include two tapered facets that form an edge angle, and the bisecting line of the edge angle may be the edge portion axis. The blade angle may be defined as the angle between the edge axis and the blade unit plane P3, when the blade unit 14 and the skin contact member 16 are separated or between the edge axis and the contact plane P1, and when the blade unit 14 and the skin contact member 16 are attached together. More precisely, each blade 20 may have a first blade angle A22 defined as the angle between the edge axis and the blade unit plane P3 and may have a second blade angle A'22 defined as the angle between the edge axis and the contact plane P1 or to the assembly plane P2 (since the assembly plane P2 is parallel to the contact plane P1). For example, the blade angle may be the same for all the blades of a blade unit 14, but the blade angle could be different from one blade 20 to another blade 20 of a same blade unit 14. In other words, the first blade angles A22 of all the blades 20 of a blade unit 14 measured with regard to the blade unit plane P3 may be equal. As such, the second blade angles A'22 of all the blades 20 of that blade unit 14, measured with regard to the contact plane P1, may also be equal. According the manner that the blade unit 14 and the skin contact member 16 are attached together, considering a blade 20, the first angle A22 may be equal to the second angle A'22.

The first angle A22 may; however, be different from the second blade angle A'22. The second blade angle A'22 may be greater or smaller than the first blade angle A22.

The first blade angle may be between 5° and 30°, and according to some aspects, may be between 12° and 27°. The second blade angle may be between 5° and 30°, and according to some aspects, may be between 18° and 22°.

As shown in FIGS. 1A, 2A, 4A, 5A and 6A, the blade angle may be the same for one blade 20, whether the blade unit 14 and the skin contact member 16 are attached together or not. As such, for each blade 20, the first blade angle A22 may be equal to the second blade angle A'22. In addition, the blade angle may be the same for all of the blades 20. The blade angle A22, A'22 may be constant and between 5° and 30°. The blade angle A22, A'22 may, in some aspects, be constant and between 10° and 25°. For instance, the first blade angle A22 and the second blade angle A'22 may be equal to 18°. As such, the attachment with the skin contact member 16 does not change the blade angle. The assembly plane P2, the contact plane P1 and the blade unit plane P3 may be parallel since the frame 30 is not provided with any ribs 37 and the connection with the housing 24 is made via the lateral faces 40. As a result, there may be no inclination obtained of the housing 24 in the frame 30.

Accordingly, in the previous example of blades 20 having the same blade exposure, when the positive exposure with regard to the blade unit plane P3 of the blade edge 22 (FIG. 6A) may be smaller than D, then the exposure of the blade edge 22 may be negative with regard to the contact plane P1 when assembled to the skin contact member 16 (FIG. 5A). Should the positive exposure with regard to the assembly plane P2 of the blade edge 22 be greater than D, then the exposure of the blade edge 22 may be positive with regard to the contact plane P1. For example, when the exposure of the blade edge 22 is equal to 100 μm with regard to the blade unit plane P3, the exposure of the blade edge 22 with regard to the contact plane P1 may be negative (D being between 0.2 mm and 0.6 mm). According to some aspects, the exposure of each of the blade edges 22 with regard to the contact plane P1 may be negative.

The blade angle, according to other aspects, may be changed when the blade unit 14 is connected to the skin contact member 16.

As seen in FIGS. 1B, 2B, 4B, 5B and 6B, the blade unit 20 may include a single blade 20. The first blade angle A22 may be smaller than the second blade angle A'22. For example, the first blade angle A22 may be about 22°, whereas the second blade angle A'22 may be reduced to about 18°. The blade unit 14 may be connected with the skin contact member 16 in an inclined due to the ribs 37. The ribs 37 may be inclined such that they may be adapted to receive the cover 28, while leading to a specific value of the second blade angle A'22. The assembly plane P2, the contact plane P1 and the blade unit plane P3 may in some aspects, not be parallel. The assembly plane P2 and the contact plane P1 may be parallel, whereas the blade unit plane P3 intersects the assembly plane P2 and the blade unit plane P3 intersects the contact plane P1. An angle β may be defined between the blade unit plane P3 and the assembly plane P2 or between the blade unit plane P3 and the contact plane P1. The angle β may be a significant contributor to the change of the blade angle between the first blade angle A22 and the second blade angle A'22.

As seen in FIGS. 1C, 2C, 4C, 5C and 6C, with three blades 20 located in a pivoting shaving blade assembly 18 having the same blade angle, the first blade angle A22 may be smaller than the second blade angle A'22. The three blades 20 located in a pivoting shaving blade assembly 18 having the same blade angle, the first blade angle A22 may; however, be larger than the second blade angle A'22. For example, the first blade angle A22 may be about 22°, whereas the second blade angle A'22 may be reduced to about 18°. The blade unit 14 may be connected with the skin contact member 16 at an incline due to an inclined inner wall 39 provided on the frame 30. The frame 30 may also be provided with ribs 37, which taken in combination with the lateral face 40, may retain the skin contact member 16 onto the housing 24. The inclined inner wall 39 may be located between the opening 38 of the housing 24 and the leading longitudinal face 34B provided internally with the ribs 37 (see FIG. 3C). The inclined inner wall 39 may be provided with different inclinations in order to receive properly and without damaging the lubra 28' provided on the housing 24. As shown in FIG. 3C and on FIG. 4C, when assembled to the pivoting shaving blade assembly 18, the frame 30 may thus have at least two inclined inner wall parts 39' and 39". The inclined inner wall part 39' may be adapted for cooperating with the lubra 28', whereas the inclined inner wall parts 39" may be adapted to cooperate with the upper face 24C of the housing 24. The ribs 37, according to some aspects, may not be inclined. As such the ribs 37 may be adapted to receive the cover 28 without leading to a specific value of the second blade angle A'22; rather, the inclined inner wall 39 may lead to this result. The assembly plane P2, the contact plane P1 and the blade unit plane P3 may not be parallel. The assembly plane P2 and the contact plane P1 may be parallel, whereas the blade unit plane P3 intersects the assembly plane P2 and the contact plane P1. An angle β may be defined between the blade unit plane P3 and the assembly plane P2 or between the blade unit plane P3 and the contact plane P1. The angle β may be a significant contributor to the change of the blade angle between the first blade angle A22 and the second blade angle A'22.

As shown in FIGS. 1D, 2D, 4D, 5D and 6D, with three blades 20 located in a fixed shaving blade assembly 18 having the same blade angle, the first blade angle A22 may be smaller than the second blade angle A'22. The frame 30 may be the same as the frame 30 connected in FIGS. 5C and 6C. As such, the above description may apply also here for FIGS. 5D and 6D.

The shaving blade 20 may have a specific configuration in order to improve a shave. More precisely, a skin contact surface area S1 of a blade unit 14 may be defined in relation with the blade unit 14 and a contact surface area S2 of a shaving blade assembly 18 may be defined in relation with the blade unit 14 and the skin contact member 16.

Figure 7A:
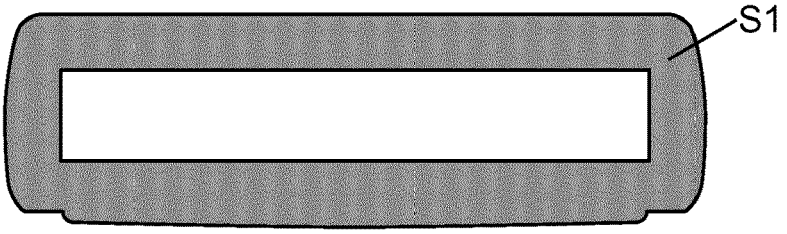
FIG. 7A is schematic upper view of the blade unit skin contact surface area.

As shown in FIG. 7A, such a blade unit skin contact surface area S1 may correspond to the surface of the blade unit 14 in contact with the skin during shaving. The blade unit skin contact surface area S1 may include the upper face 24C of the housing (with the guard bar 26 and the lubra 28) and the clips 23, when they exist. The blades 20 contained in the housing 24 may not be taken into account since their contact with the skin is more or less null. Besides, when the blades 20 are movable, this contact surface changes during one shaving but it does not change the area and ratios, as they are the same.

Figure 7B:
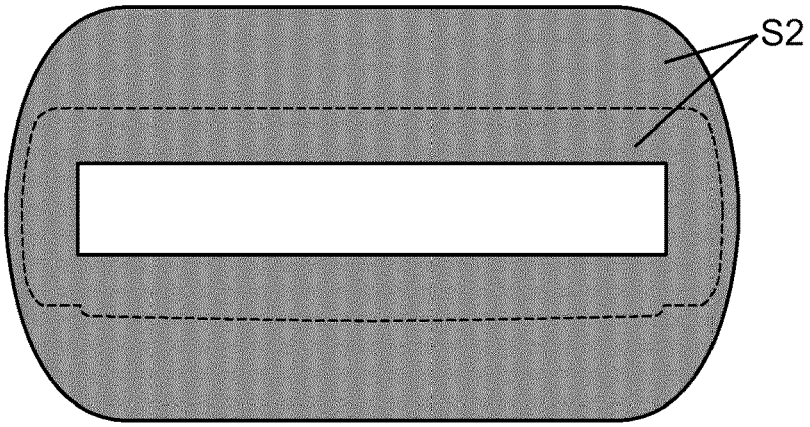
FIG. 7B is schematic upper view of the shaving blade assembly skin contact surface area.

FIG. 7B shows the shaving blade assembly skin contact surface area S2 that corresponds to the surface of the skin contact member 16, and of the accessible surface of the blade unit 14, accessible through the skin contact member 16 in contact with the skin S during shaving. More precisely, the accessible surface of the blade unit 14 may be the lubra 28 and the guard bar 26 which are on the shaving head plane. The shaving head plane may be in vertical distance with the adaptor top surface plane. The shaving blade assembly skin contact surface area S2 may include the two transverse surfaces 42A, the trailing planar surface 36A, the trailing planar surface 36A and a part of the upper face 24C of the housing 24 (with the guard bar 26 and the lubra 28.) Clips 23, although provided on the blade unit 14, may not be considered as a part of the shaving blade assembly skin contact surface area S2, as they are covered by the transverse surfaces 42A. According to some aspects, for example, where the blades 20 may be secured to the housing 24 with an element other than the clips 23 (or may be fixed blades, as in FIGS. 1B to 1D), the shaving blade assembly skin contact surface area S2, depending its position with regard to the opening 38, may or may not be disposed within the opening 38 of the skin contact member 16. As detailed above, the blades 20 contained in the housing 24 may also not be taken into account with respect to the shaving blade assembly skin contact surface area S2.

During a shave, and according to the shaving process, the razor 10 may be applied against the skin S to be shaved. Some parts of the razor 10 may come in contact with the skin and forces may act in reaction to application of the razor 10 against the skin S. The force distribution may be connected to the surface of the razor 10 in contact with the skin S. As such the surface of the razor 10 in contact with the skin S, in order to obtain a safer shave and provide a pleasurable shaving experience (improved glideness, softness and/or skin hydration and reduced shaving time), must be optimized.

Figure 9:
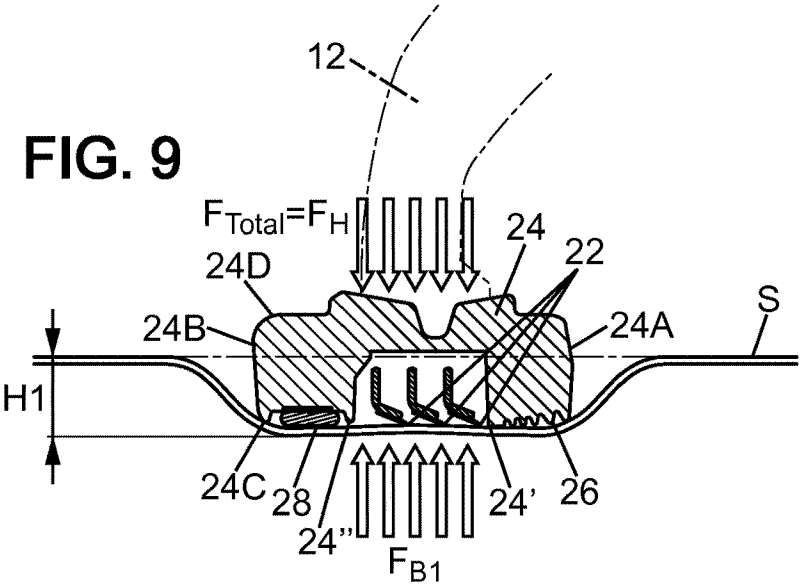
FIG. 9 is a schematic transverse sectional view of a razor of the prior art during shaving.

According to some aspects where shaving may occur with a razor 10 including a blade unit 14 onto which no skin contact member 16 is provided (meaning a razor of the prior art), the skin S may deform as depicted schematically on FIG. 9 with a deformation or penetration of the skin S of H1.

Figure 10:
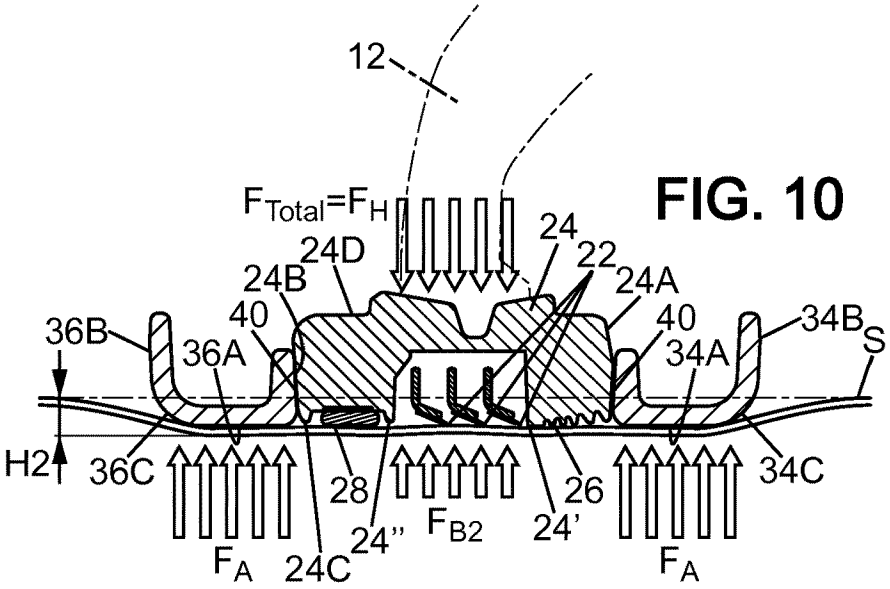
FIG. 10 is a schematic transverse sectional view of a razor according to the present disclosure during shaving.

According to further aspects where shaving may occur with a razor 10 including a blade unit 14 onto which a skin contact member 16 may be provided, the skin S may deform as depicted schematically on FIG. 10 with a deformation or penetration of the skin S of H2.

Clearly, it appears that the skin S deforms differently when the razor 10 may be provided with a skin contact member 16. A smoother contact may be obtained with the razor 10 according to the present disclosure wherein the height H2 may always be smaller than H1.

During shaving, the razor 10 may apply a force $F_H$ against the skin S with a razor handle; in response, a total force $F_{Total}$ may occur. For ease of presentation, arrows show the distribution of the forces of interest, where

- $F_A$: Reaction force from the skin S to the skin contact member 16
- $F_{B1}$: Reaction force from the skin S to the razor 10, in the case where no skin contact member 16 is used
- $F_{B2}$: Reaction force applied from the skin S to the blade unit 14, in the case where the skin contact member 16 is used.
- Both forces $F_H$ and $F_{Total}$ are equal in both cases (with and without the skin contact member 16).

In reference to the razor 10 of FIG. 7A (without the skin contact member 16), the total force $F_{Total}$ is in this case equal to the force applied from the skin S to the razor 10, that is $F_{Total}=F_{B1}=F_H$.

In reference to FIG. 10 (with the skin contact member 16), the total force $F_{Total}$ is equal to the force applied from the skin S to the razor 10, that is $F_{Total}=F_A+F_{B2}=F_H$.

Without the skin contact member 16, the razor 10 may cause an intense deformation that may create the depth H1, into the skin S. Furthermore, the concentration of the contact forces $F_{B1}$ may be a result of the Force $F_H$ that may be applied on the skin S on an area equal to the blade unit 14 front area which may be significantly smaller with respect to the skin protector 16 front area. The skin contact member 16 may be in contact with the skin S and the skin contact member 16 may absorb a greater percentage of the total forces. As a result, less force may be applied to the skin S from the blades than in the previously, where no skin contact member 16 is used: $|F_{B2}|<|F_A|$, $|F_{B2}|<|F_{B1}|$.

As seen in FIG. 10, with the skin contact member 16, the Force $F_H$ may be distributed on a larger area under the razor 10 and the skin contact member 16 may cause a significantly less intense and smoother skin deformation creating a depth H2 which may be smaller than H1. The shape of local deformation of the skin S may also be reduced when a skin contact member 16 is provided. As a result, the skin contact member 16 may provide a safe distance between the blades 20 and the skin S with improved glideness, thus reducing nicks cuts.

Figure 8:
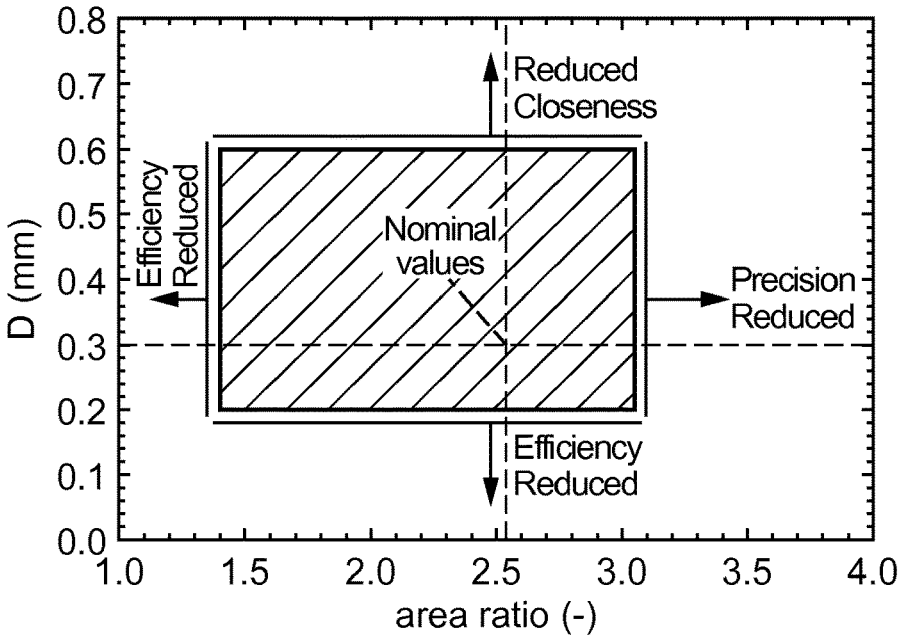
FIG. 8 is a graph representing an operating window relating to the ratio and the distance between the contact plane and the shaving plane.

As illustrated on the graph depicted in FIG. 8, the best results of improving shaving, glideness and security while reducing the time needed to shave may be obtained when the ratio S2/S1 between the shaving blade assembly skin contact surface area S2 and the blade unit skin contact surface area S1 may be between 1.4 and 3.1. The ratio S2/S1 may be between 2 and 3.1. The ratio S2/S1, in some aspects, may between 1.4 and 1.95. The efficiency of skin contact member 16 may be reduced when the ratio S2/S1 is smaller than 1.4 and the precision of shaving may be reduced when the ratio S2/S1 is greater than 3.1. The ratio S2/S1, may be for example, between 1.4 and 1.95 for shaving an area like the face or the underarms. However, the ratio S2/S1, may be for example, between 2 and 3.1 for shaving a large part of the body, like a leg for instance.

According to an aspect, results of shaving (cutting, softness, glideness, etc.) may be obtained with a shaving blade assembly 18 having a ratio S2/S1 between 2 and 3.1 and a distance D between the contact plane P1 and the assembly plane P2 between 0.1 mm and 0.6 mm. Nominal values for which the best results may be obtained, and for which may be an ideal design of the shaving blade assembly 18, may be where the ratio S2/S1 is about 2.5 and the distance D is about 0.3 mm.

Several kinds of materials may be used for the skin contact member 16. The skin contact member 16 may; however, be made in one piece and may be made of a single material. The materials may be chosen among plastic such as ABS or high polished thermoplastic and metal such as aluminum or light alloy or lacquered wood. The roughness of the material of the skin contact member 16, especially for the leading planar surface 34A and the trailing planar surface 36A may be such that the friction coefficient against the skin S leads to a good stretch of the skin S and a good glideness. For instance, the friction coefficient may be between 0.3 and 0.7 when the skin contact member 16 includes a plastic as mentioned above. The friction coefficient may be between 1.05 and 1.35 when the skin contact member 16 includes a metal as mentioned above. The friction coefficient may be between 0.25 and 0.5 when the skin contact member 16 includes a lacquered wood as mentioned above. The noted friction coefficients may allow the skin contact member 16 to function as if it was lubricated.

The skin contact member 16 may act against the skin especially in stretching the skin in front of the blade edges 22 such that hair on the skin may be extend, more or less, perpendicular to the contact plane P1. The skin contact member 16 may also act against the skin to spread a shaving aid (such as shaving cream and regular soap) possibly put on the skin; thereby potentially assisting in improving penetration of the shaving aid. The skin may be better hydrated when the shaving aid includes a hydrating product.

An example of geometry of a shaving blade assembly 18 may include the skin contact member 16 having a length L1 along the longitudinal axis X-X between 40 mm and 50 mm. In some aspects, the length L1 may be about 45 mm. The skin contact member 16 may have a width L2, perpendicular to the longitudinal axis X-X, between 20 mm and 30 mm. In some aspects, the width L2 may be about 25 mm. These dimensions may be measured at their maximum values, especially when the skin contact member 16 has curved lateral faces 42B as depicted on the figures. The skin contact member 16 may be symmetric with regard to the longitudinal axis X-X. The opening 38 of the skin contact member 16 may centered on the last.

The dimensions of the skin contact member 16 may be adapted such that the skin contact member 16 may be capable of fitting on the housing 24 of the blade unit 14. For example, with regards to the blade unit 14 including three blades 20 and clips 23 (see FIG. 1A), the opening 38 may be rectangular when viewed from an upper side and may have a length L3 taken along the longitudinal axis X-X between 30 mm and 40 mm. According to some aspects, the length L3 may be 35 mm. A width L4 taken perpendicular to the longitudinal axis X-X may be between 8 mm and 20 mm. According to further aspects, the width L4 may be about 12 mm.

In reference to the blade unit 14 including one blade 20 (see FIG. 1B), the opening 38 may be rectangular when viewed from an upper side and may have a length L3 taken along the longitudinal axis X-X between 30 mm and 40 mm. According to another aspect, the length L3 may be 35 mm. A width L4 taken perpendicular to the longitudinal axis X-X may be between 5 mm and 8 mm. According to further aspects, the width L4 may be about 6.5 mm.

Regarding the blade unit 14 including three blades 20 disposed in a pivoting housing 24 (see FIG. 1C) or a fixed housing 24 (see FIG. 1D), the opening 38 may be rectangular when viewed from an upper side and may have a length L3 taken along the longitudinal axis X-X between 30 mm and 40 mm. According to some aspects, the length L3 may be 35 mm and may have a width L4 taken perpendicular to the longitudinal axis X-X between 5 mm and 15 mm. According to some aspects, the width L4 may be about 9.5 mm.

The above dimensions of L1 and L3, taken along the longitudinal axis X-X, may be the same should they be measured from an upper side of the skin contact member 16 or from a lower side of the skin contact member 16. The lateral faces 42B may each be planar and perpendicular to the contact plane P1 defined by the leading planar surface 34A and the trailing planar surface 36A.

The above dimensions of L2 and L4, taken perpendicularly to the longitudinal axis X-X, may vary slightly. More precisely, the length L2 may be measured on the lower side (between the free ends of the leading longitudinal face 34B and of the trailing longitudinal face 36B; respectively opposite the leading curved face 34C and the trailing curved face 36C) of the skin contact member 16. Variations in L2 and L4 may be less important when measured on the upper side of the skin contact member 16. The leading longitudinal face 34B and the trailing longitudinal face 36B may be slightly inclined with regard to a perpendicular to the contact plane P1. For example, the leading longitudinal face 34B and the trailing longitudinal face 36B may each have an angle $\alpha$ measured with regard to the contact plane P1 which may be between 85° and 95°. According to some aspects, the angle $\alpha$ may be about 92°.

The lateral parts 40 of the inner wall of the skin contact member 16 fit to the housing 24 and may also be slightly inclined with regard to a perpendicular to the contact plane P1. Thus, the value given for the width L4 may be measured on the upper side of the skin contact member 16. Dimensions for L3 and L4, corresponding to the opening 38, may be measured on the upper side of the skin contact member 16 to ensure that the blades 20, the guard bar 26 and the lubra 28 may be accessible through the opening 38 during shaving.

As best seen in FIGS. 4A to 4D and FIGS. 5A to 5D, the height H, of the skin contact member 16 measured between the contact plane P1 and the free ends of the leading longitudinal face 34B and of the trailing longitudinal face 36B (respectively opposite the leading curved face 34C and the trailing curved face 36C), may be between 3 mm and 7 mm. According to some aspects, the height H may be about 5 mm.

The shaving blade assembly 18 may include a connecting means for connecting the shaving blade assembly 18 to the razor handle 12. More precisely, either the blade unit 14 or the skin contact member 16 may be provided with a connecting means for connecting the shaving blade assembly 18 to the razor handle 12.

As shown in FIGS. 1A to 1C, the connecting means 44 (as best seen on FIGS. 5A to 5C) may allow a pivot of the shaving blade assembly 18 with regard to the razor handle 12 (around the elongated axis X-X), but the invention may not be limited to a pivotable shaving blade assembly 18 The connecting means 44 may be provided on the blade unit 14 at the lower face 24D of the housing 24.

The connecting means 44 may include shell bearings, especially when the shaving blade assembly 18 is pivotable with regard to the razor handle 12, but the invention may not be limited to this kind of connecting means. The handle 12 may be detachable from the blade unit 14 or non-detachable. The handle 12 may be detachable when the razor 10 is a system (meaning the blade unit 14 may be changed by a new blade unit 14 when the blades 20 are dulled, while the handle 12 remains). The handle 12 may be non-detachable when the razor 10 is a disposable (meaning both the blade unit 14 and the handle 12 are changed by new blade units 14 and handles 12 when the blades 20 are dulled).

The skin contact member 16 may frictionally receive the blade unit 14 such that the blade unit 14 may be mounted and naturally maintained in the blade unit 14. As such, the frame 30 of the skin contact member 16 may be designed to cooperate via a friction fit with the housing 24 of the blade unit 14.

The skin contact member 16 may also be elastically mountable on the blade unit 14. For example, the frame 30 of the skin contact member 16 may deform elastically during connection to the blade unit 14. This means that the elasticity of the frame 30 is higher than that of the shaving housing 24. To this extent, the inner wall 39 and especially the lateral parts 40 may have a non-contiguous shape and may be provided with a wave-like texture in order to increase the elasticity of the inner wall 39 especially during the mounting of the skin contact member 16 onto the housing 24.

According to the friction forces and to the elasticity of the skin contact member 16, after mounting, the skin contact member 16 may be permanently connected to the blade unit 14 or, in some aspects, may be releasably (i.e. detachably) connected to the blade unit 14. When the skin contact member 16 is releasably connected to the blade unit 14, the friction between the skin contact member 16 and the blade unit 14 may be such that the skin contact member 16 is maintained on the blade unit 14 thereby allowing for a shave without risk of detachment. A voluntary release/detachment of the skin contact member 16 from the blade unit 14 may be realized without using a significant force. Thus, separation of the skin contact member 16 from the blade unit 14 may be obtained without the help of a tool.

In reference to FIGS. 10 to 14, the shaving blade assembly may include a cover 46. The cover 46 may assist with protecting the shaving blade assembly 18 (at least the blade unit 14; and may, more precisely shield each of the blade edges 22) from dirt thereby protecting the user from inadvertently being cut.

The protective cover 46 may be completely detachable (see FIG. 11) from the shaving blade assembly 18 and may be slidable on the shaving blade assembly 18 such that the protective cover 46 may be easily put on and released from the shaving blade assembly 18. The protective cover 46 may be provided with at least one locker. The locker may cooperate with a corresponding locker slot. The corresponding locker slot may be provided on the skin contacting member 16 and may be shaped to receive the locker in order to hold the protective cover 46 in a full stop position on the shaving blade assembly 18. As seen in FIG. 14 the protective cover 46 may totally cover, more or less, the shaving blade assembly 18. Thus, the protective cover 46 cannot be accidentally detached from the shaving blade assembly 18.

Figure 11:
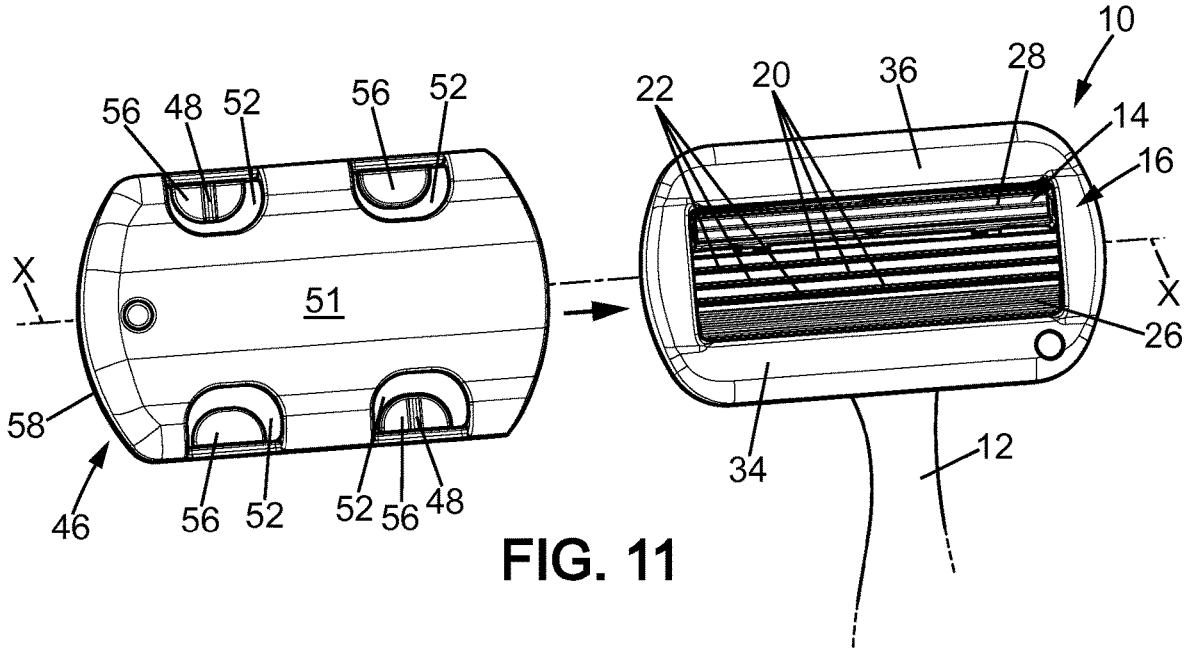
FIG. 11 is a perspective view of the razor of the invention with a detached protective cover.
Figure 12:
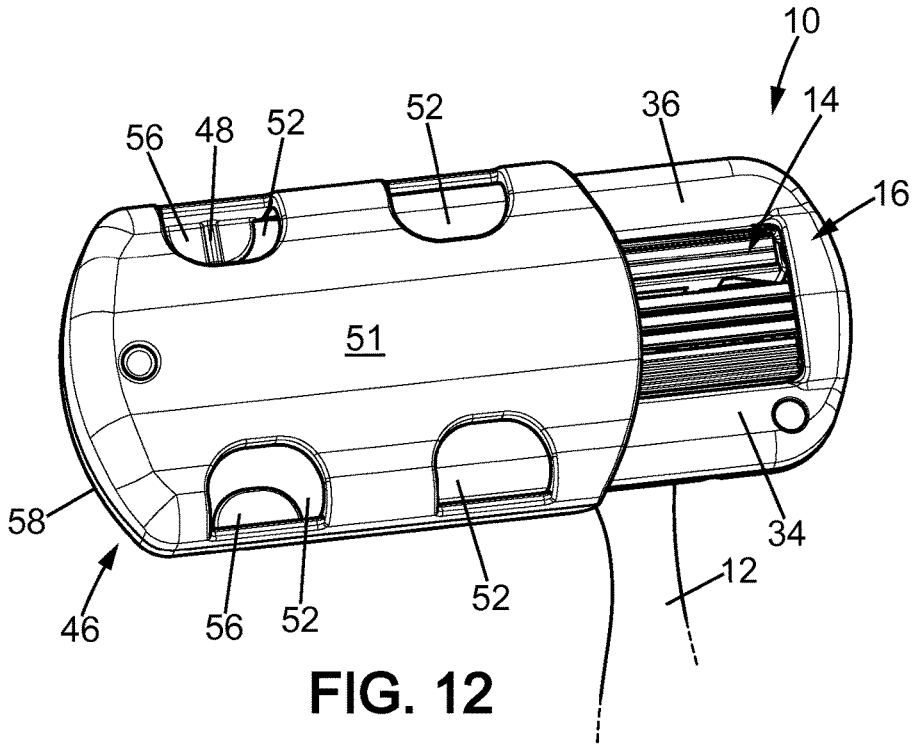
FIG. 12 is a perspective view of the razor of FIG. 11 with the protective cover partly attached.

As shown in FIG. 11, the protective cover 46 may be provided with two lockers 48 provided on the rear face of the protective cover 46 for cooperating with two respective locker slots 50 (as best visible in FIGS. 3 and 4) provided on the skin contact member 16.

The protective cover 46 may include an upper face 51 which may be provided with openings 52 to allow for aeration of the shaving blade assembly 18. As shown in FIGS. 10, 11 and 13, four openings 52 may be provided, for example, on the upper face 51 of the protective cover 46. When the protective cover is in the full stop position, two of the openings 52 may be located in front of the leading skin contact part 34 and two of the openings 52 may be in front of the trailing skin contact part 36.

Tabs 56 are provided on a rear face of the protective cover 46. For example, four tabs 56 may be provided such that the protective cover 46 is capable of encasing the shaving blade assembly 18 when slid thereon. The tabs 56 and the upper face 51 may define a volume in which the shaving blade assembly 18 may be received when the protective cover 46 is slid on the razor 10. The protective cover 46 may further include a bottom abutment 58 that may an abutment for the protective cover 46 when the protective cover is slid onto the shaving blade assembly 18.

The lockers 48 may each include a rib 48 and may be provided on the inner surface of the tabs 56. For example, a first locker 48 may be located on one of the tabs 56, on the side of the leading skin contact part 34 and a second locker 48 may be located on one of the tabs 56 on the side of the trailing skin contact part 36. A first locker slot 50, corresponding to the first locker 48, may be provided on the protective cover 46 on the side of the leading skin contact part 34. A second locker slot 50 may be provided on the protective cover 46 on the side of the trailing skin contact part 36. Several lockers 48 and lockers slots 50 may be provided. For example, one locker 48 may be provided on each of the four tabs 56 in order to snap-fit in four corresponding locker slots 50 as visible on FIG. 13. Similarly, the lockers 48 may be provided on the protective cover 46 and the locker slots 50 on the skin contact member 16 According to another aspect, the lockers 48 may be provided on the skin contact member 16 and the locker slots 50 may be provided on the protective cover 46. According to further aspects, a combination of lockers 48 and locker slots 50 may be provided on the skin contact member 16 and locker 48 and locker slots 50 may be provided on the protective cover 46. In summary, at least one locker 48 and one locker slot 50 may be provided on the skin contact member 16 and on the protective cover 46.

When the protective cover 46 is completely slid on the shaving blade assembly 18, the protective cover 46 may be in a full stop position and the lockers 48 may be disposed in the locker slots 50. The protective cover 46 may be able to slide on the shaving blade assembly 18 until the lockers 48 snap-fit in the locker slots 50.

In reference, to FIG. 15, the connecting means 44 may still accessible when the protective cover 46 is connected on the shaving blade assembly 18. As such, there is no need to detach the razor handle 12 from the shaving blade assembly 18 to attach/detach the protective cover 46.

The protective cover 46 may be made from a material chosen among plastic, for example, ABS, polypropylene, etc. The protective cover 46 may be molded in one piece.

The invention claimed is:

1. A shaving blade assembly comprising:

a blade unit, and a skin contact member;

the blade unit including an elongated housing extending along and defining a longitudinal axis, the blade unit including a guard bar and a cap, the housing including an upper face, and at least one shaving blade having a cutting edge facing toward the upper face of the housing;

the guard bar and the cap of the blade unit defining a blade unit plane, the cutting edge and the blade unit plane defining a first blade angle;

the skin contact member including a leading skin contact part extending in front of the at least one shaving blade and a trailing skin contact part extending rearward of the at least one shaving blade;

the leading skin contact part including a leading surface and the trailing skin contact part including a trailing surface, the leading surface and the trailing surface defining a contact plane; and the cutting edge and the contact plane defining a second blade angle, wherein the skin contacting member is releasably connected to the blade unit; and the skin contact member including an inclined wall and/or one or more ribs operable to abut against the blade unit to hold the blade unit at an incline such that the blade unit plane and the contact plane are not parallel and the second blade angle is different from the first blade angle.

2. The shaving blade assembly according to claim 1, wherein the cutting edge includes a first blade exposure with regard to the blade unit plane and the cutting edge includes a second blade exposure with regard to the contact plane.

3. The shaving blade assembly according to claim 1, wherein the blade unit plane and the contact plane are intersecting.

4. The shaving blade assembly according to claim 1, wherein the leading surface is planar and the trailing surface is planar.

5. The shaving blade assembly according to claim 1, wherein the blade unit is attached to the skin contacting member and forms the blade assembly such that the blade assembly includes an assembly plane, the assembly plane is parallel to the contact plane and the contact plane is tangent to the aft-most blade edge.

6. The shaving blade assembly according to claim 5, wherein a distance exists between the contact plane and the assembly plane, and the distance between the contact plane and the assembly plane is between 0.2 mm and 0.6 mm.

7. The shaving blade assembly according to claim 1, wherein the blade unit includes a blade unit skin contact surface area, the blade unit and the skin contact member includes a shaving blade assembly skin contact surface area, wherein a ratio between the shaving blade assembly skin contact surface area and the blade unit skin contact surface area is between 2 and 3.1.

8. The shaving blade assembly according to claim 1, wherein the blade unit includes a blade unit skin contact surface area, the blade unit and the skin contact member includes a shaving blade assembly skin contact surface area, wherein a ratio between the shaving blade assembly skin contact surface area and the blade unit skin contact surface area is between 1.4 and 1.95.

9. The shaving blade assembly according to claim 1, wherein the skin contact member surrounds the blade unit.

10. The shaving blade assembly according claim 9, wherein the skin contact member is snap-fitted to the blade unit.

11. The shaving blade assembly according to claim 1, wherein the skin contact member is formed from a plastic material and includes a friction coefficient of between 0.3 and 0.7.

12. The shaving blade assembly according to claim 1, wherein the skin contact member is formed from a metal material and includes a friction coefficient of between 1.05 and 1.35.

13. The shaving blade assembly according to claim 1, wherein the skin contact member is formed from a lacquered wood and includes a friction coefficient of between 0.25 and 0.5.

14. The shaving blade assembly according to claim 1, wherein the skin contact member is connected to the upper face of the blade unit.

15. The shaving blade assembly according to claim 1, wherein the skin contact member includes a thermochromic pigment.

16. The shaving blade assembly according to claim 1, wherein the blade unit includes a first part of the housing located in front of the at least one shaving blade and a second part of the housing located rearward of the at least one shaving blade, wherein the blade unit plane forms a tangent of the first part and the second part of the housing of the blade unit.

17. A razor comprising:

a razor handle and a shaving blade assembly;

the shaving blade assembly including a blade unit, and a skin contact member;

the blade unit including an elongated housing extending along and defining a longitudinal axis, the blade unit including a guard bar and a cap, the housing having an upper face, and at least one shaving blade having a cutting edge facing toward the upper face of the housing;

the guard bar and the cap of the blade unit defining a blade unit plane, the cutting edge and the blade unit plane defining a first blade angle;

the skin contacting member being releasably connected to the blade unit;

the skin contact member including a leading skin contact part extending in front of the at least one shaving blade and a trailing skin contact part extending rearward of the at least one shaving blade;

the leading skin contact part including a leading surface and the trailing skin contact part including a trailing surface, the leading surface and the trailing surface defining a contact plane;

the cutting edge and the contact plane defining a second blade angle, wherein the skin contact member includes an inclined wall and/or one or more ribs operable to abut against the blade unit to hold the blade unit at an incline such that the blade unit plane and the contact plane are not parallel and the second blade angle is different from the first blade angle; and the shaving blade assembly includes a connecting means for connecting the shaving blade assembly to the razor handle.

18. The razor according to claim 17, wherein the blade unit includes a first part of the housing located in front of the at least one shaving blade and a second part of the housing located rearward of the at least one shaving blade, wherein the blade unit plane forms a tangent of the first part and the second part of the housing of the blade unit.

* * * * *